US012441528B2

(12) United States Patent
Ahn

(10) Patent No.: US 12,441,528 B2
(45) Date of Patent: Oct. 14, 2025

(54) CONTAINER CAP AND CONTAINER HAVING SAME COUPLED THERETO

(71) Applicant: Jin Hee Ahn, Yongin-si (KR)

(72) Inventor: Jin Hee Ahn, Yongin-si (KR)

( * ) Notice: Subject to any disclaimer, the term of this patent is extended or adjusted under 35 U.S.C. 154(b) by 0 days.

(21) Appl. No.: 18/689,301

(22) PCT Filed: Sep. 6, 2022

(86) PCT No.: PCT/KR2022/013395
§ 371 (c)(1),
(2) Date: Mar. 5, 2024

(87) PCT Pub. No.: WO2023/033632
PCT Pub. Date: Mar. 9, 2023

(65) Prior Publication Data

US 2024/0375835 A1 Nov. 14, 2024

(30) Foreign Application Priority Data

Sep. 6, 2021 (KR) ..... 10-2021-0119185
Feb. 3, 2022 (KR) ..... 10-2022-0014788
(Continued)

(51) Int. Cl.
*B65D 51/22* (2006.01)
*B65D 41/34* (2006.01)

(52) U.S. Cl.
CPC ..... *B65D 51/224* (2013.01); *B65D 41/3423* (2013.01); *B65D 2251/0015* (2013.01); *B65D 2251/009* (2013.01)

(58) Field of Classification Search
CPC ..... B65D 51/224; B65D 41/3423; B65D 2251/0015; B65D 2251/009
(Continued)

(56) References Cited

U.S. PATENT DOCUMENTS 5,119,964 A * 6/1992 Witt ..... B65D 51/20 215/232
6,269,986 B1 * 8/2001 Gross ..... B65D 47/0804 222/153.06
(Continued)

FOREIGN PATENT DOCUMENTS

JP H05-034149 U 5/1993
JP 2005-193941 A 7/2005
(Continued)

*Primary Examiner* — Anthony D Stashick
*Assistant Examiner* — Niki M Eloshway
(74) *Attorney, Agent, or Firm* — Rabin & Berdo, P.C.

(57) ABSTRACT

Provided are a container cap coupled to the mouth of a container in which contents are contained; and a container to which the container cap is coupled. The container cap includes: a main body part coupled to a container inlet of a container and having an opening formed on an upper side thereof; a cover part connected to the main body part by a hinge part and opening and closing an upper opening of the main body part by hinge rotation; a separation part connected to the cover part by a first connection part and connected to the main body part by a second connection part detachably; and a fixing part formed on the cover part so that the separation part is fixedly coupled thereto after the second connection part is separated by a user's manipulation so that the cover part can be separated from the main body part.

16 Claims, 43 Drawing Sheets

(30) Foreign Application Priority Data

Feb. 9, 2022 (KR) ..... 10-2022-0017004
Aug. 17, 2022 (KR) ..... 10-2022-0103227

(58) Field of Classification Search
USPC ..... 215/200
See application file for complete search history.

(56) References Cited

U.S. PATENT DOCUMENTS

| | | | | |
|---|---|---|---|---|
| 8,047,387 | B2 * | 11/2011 | Chalekian | B65D 51/242 215/200 |
| 8,292,101 | B1 * | 10/2012 | Bragg | B65D 47/0838 220/254.5 |
| 2008/0302752 | A1 * | 12/2008 | Farrar | B65D 51/20 215/200 |
| 2020/0277112 | A1 * | 9/2020 | Gift | B65D 47/0838 |
| 2022/0041347 | A1 * | 2/2022 | Skillin | B05B 11/047 |

FOREIGN PATENT DOCUMENTS

| | | | | |
|---|---|---|---|---|
| JP | 2009083890 | A | 4/2009 | |
| JP | 2009538795 | A | 11/2009 | |
| JP | 2011-219110 | A | 11/2011 | |
| JP | 2019-142534 | A | 8/2019 | |
| JP | 2020196474 | A | 12/2020 | |
| KR | 10-0735846 | B1 | 7/2007 | |
| WO | WO-9857864 | A1 * | 12/1998 | B65D 47/0804 |
| WO | WO-2016063641 | A1 * | 4/2016 | B32B 27/08 |
| WO | 2021/010779 | A1 | 1/2021 | |
| WO | 2021/071348 | A1 | 4/2021 | |
| WO | WO-2023137052 | A1 * | 7/2023 | B65D 47/0804 |

* cited by examiner

CONTAINER CAP AND CONTAINER HAVING SAME COUPLED THERETO

TECHNICAL FIELD

The present invention relates to a container cap, and more particularly, to a container cap coupled to a container inlet of a container containing contents, and a container to which the container cap is coupled.

BACKGROUND ART

A container cap is coupled to a container inlet of a container containing contents to seal the container, and various types of container caps are coupled according to the type of contents contained in the container and discharging and opening manners.

FIG. 1 is a perspective view illustrating a container to which a container cap is coupled according to the related art.

The container cap according to the related art may be a container cap coupled to a container 3 containing contents in the form of granules such as gum and be configured as illustrated in FIG. 1.

Particularly, the container cap 1 illustrated in FIG. 1 according to the related art includes a main body part 7 coupled to a container inlet of the container 3 containing contents and opened upward, a cover part 5 coupled to the main body part 7 to open and close an upper opening of the main body part 7, and a use trace belt 9 coupled to a lower end of the cover part 5 and an upper end of the main body part 7 and separated from the cover part 5 and the main body part 7 by a user to allow the cover part 5 to open and close the upper opening of the main body part 7.

Here, the use trace belt 9 is coupled to the lower end of the cover part 5 and the upper end of the main body part 7 and is separated from the cover part 5 and the main body part 7 by the user to allow the cover part 5 to open and close the upper opening of the body 7.

In addition, the use trace belt 9 is characterized in that the use trace belt 9 is formed together when the container cap 1 is formed by plastic injection molding, is coupled to the lower end of the cover part 5 and the upper end of the main body part 7, and is removed after being separated from the lower end of the cover part 5 and the upper end of the main body part 7 along cut structure made in the lower end of the cover part 5 and the upper end of the main body part 7 or separation lines 7*a* and 7*b* such as a plurality of bridges.

However, as waste plastics are the main culprit of environmental pollution due to the recent rapid increase in amount of used plastics, there is a national or social demand to minimize or recycle the plastics.

In the container cap illustrated in FIG. 1 according to the related art, when the use trace belt 9 is used, the use trace belt 9 is separated from the container cap 1 and then discarded, and thus, there is a problem in that it is difficult to recycle the plastic materials while increasing in amount of plastic materials.

In addition, in the container cap illustrated in FIG. 1 according to the related art, since the user has to separate the use trace belt 9 along a circumferential direction of the container cap 1, there is a problem in that a separation operation of the use trace belt 9 is cumbersome.

(Patent Document 1) WO WO2021/071348 A1

(Patent Document 2) WO WO2021/010779 A1

DISCLOSURE OF THE INVENTION

Technical Problem

In order to solve the above problems, an object of the present invention is to provide a container cap that is implemented as an integrated plastic container cap to facilitate collection of waste plastics so as to recycle the waste plastics and is easy to be used, and a container coupled thereto.

In order to solve the above problems, another object of the present: invention is to provide a container cap including a main body part coupled to a container inlet and a cover part detached from the main body part by rotation of a hinge to improve sealing force for a container, and a container coupled thereto.

Technical Solution

The present invention has been invented to achieve the purpose of the present invention as described above, and the present invention discloses a container cap including: a main body part (100) which is coupled to a container inlet (20) of a container (30) containing contents and has an opening defined in an upper side thereof; a cover part (200) which is integrally connected to the main body part (100) by a hinge part (530) to open and close an upper opening of the main body part (100) by hinge rotation; a separation part (300) which is integrally connected to the cover part (200) by a first connection part (510) and is integrally detachably connected to the main body part (100) by a second connection part (520); and a fixing part (400) disposed on the cover part (200) so that the separation part (300) is fixedly coupled thereto after the second connection part (520) is separated by user's manipulation so that the cover part (200) is separated from the main body part (100).

The separation part (300) may be provided with one or more concave parts (310) when viewed at an upper side in a state of being connected to the main body part (100), and the fixing part (400) may be provided with a protrusion (410) fitted into the concave part (310) of the separation part (310) by separating and tilting the separation part (300) from the main body part (100).

Each of the concave part (310) and the protrusion (410) may be provided in a pair to correspond to each other.

The concave part (310) may have a narrow inlet portion based on the insertion direction, and the protrusion (410) may have a wide width at an end portion thereof to correspond to the inlet portion of the concave part (310).

The concave part (310) may be provided with a first convex part (319) that protrudes further from a central portion toward an outer portion when viewed from above, and the protrusion (410) may be provided with a second convex part (411) that faces the first convex part (319) of the concave part (310) to further protrude.

The fixing part (400) may include a covering part (490) having a projected area that comprises an entire upper side of the protrusion (410) when viewed from the above.

The covering part (490) may be provided with a hook part (491) protruding downward from a center of the container cap at an end portion, and the separation part (300) may be provided with a fitting groove (391) into which the hook part 491 is fitted in the state of being separated from the main body part (100) and folded upward.

The main body part (100) may be provided with a cutoff part (190) corresponding to an outer circumferential shape of the separation part (300), and the second connection part (520) may be provided in one or more to be connected between an edge of the separation part (300) and an inner circumference of the cutoff part (190).

The cover part (200) may be provided with an inner ring (280) that protrudes from a bottom surface and is inserted into an inner circumferential surface of the container inlet (20) to improve sealing force of the container (30).

The container inlet (20) may be provided with a convex portion (23) that is convex inward to be in contact with the inner circumferential surface of the inner ring (280) in the state in which the cover part (200) is coupled to the main body part (100).

The inner ring (280) may have a portion corresponding to the hinge part (510), which further protrudes downward than a portion corresponding to the fixing part (400).

The inner ring (280) may include: a first portion (281) provided at a preset angle by using the fixing part (400) as a center of an angle and having a constant vertical distance; and a second portion (282) having a center of the hinge part (510) as the lowest point and having a vertical distance that increases downward from the first portion (281).

The cover part (200) may further include an auxiliary inner ring (293) that is in close contact with an inner circumferential surface of the container inlet (30) outside the inner ring (280).

The cover part (200) may be provided with a second hook protrusion (210) protruding toward an inner circumference so as to be hooked on the first hook protrusion (22) protruding toward an outer circumference near an upper end of the container inlet (20).

The main body part (200) may be provided with a fourth hook protrusion (110) that is hooked with a third hook protrusion (21) disposed on an outer circumferential side of the container inlet (20) so as to be fixed to the container inlet (20).

The present invention also discloses a container including: a container (30) containing contents; and a container cap (10) having the above structure, which is coupled to a container inlet (20) of the container (30).

Advantageous Effects

The container cap and the container to which the container is coupled according to the present invention, when checking the opening traces of the container, is coupled to the container inlet and consists of a main body part having an opening formed on the upper side, and a cover part opening and closing the opening of the main body part, and the main body part And by further comprising a separation part integrally formed with any one of the cover part and separably coupled to the other one, there is an advantage in that it is easy to collect and use the waste plastic for recycling.

That is, the container cap according to the present invention may have the advantage of being easy to collect the waste plastic for recycling and to be used because the main body part and the cover part are integrated with each other by the plastic injection.

The container according to the present invention may have the advantage of the simple structure without the separate configuration for the traces of the use because of being opened by the rupture of the second connection part when initially opened.

In particular, in the container according to the related art, the use of unnecessary plastic may increase as the means for checking whether or not the container is used as the belt that is separated from the container cap, but in the present invention, when initially opened, the container cap may have the advantage of being opened by the rupture of the second connection part that connects the separation part to the main body part and operating by the user's simple manipulation, thereby simplifying the structure without the separate configuration required for the trace of the use so that the environmental waste as waste are not generated.

In addition, the container cap according to the present invention may have the advantage of safely storing the contents of various materials (pills, powders, liquids, etc.) stored in the storage space of the container from the external air and moisture by more airtightly sealing the container in terms of the coupling structure with the container inlet.

BRIEF DESCRIPTION OF THE DRAWINGS

FIG. 11*a* is a perspective view before a separation part is separated, and FIG. 11*b* is a perspective view illustrating a state in which the separation part is separated to be coupled to a fixing part.

FIG. 16*a* is a perspective view before a separation part is separated, and FIG. 16*b* is a perspective illustrating a state in which the separation part is separated to be coupled to a fixing part.

FIG. 17*a* is a plan view before the separation part is separated, and FIG. 17*b* is a plan view illustrating a state in which the separation part is separated to be coupled to a fixing part.

FIG. 19*a* is a cross-sectional view before a separation part is separated, FIG. 19*b* is a cross-sectional view illustrating a state in which the separation part is separated to be coupled to the fixing part, FIG. 19*c* is a cross-sectional view illustrating a state in which a cover part is separated from a container inlet and is tilted, FIG. 19*d* is a cross-sectional view illustrating a state in which a sealing member is separated from the cover part, and FIG. 19*e* is a cross-sectional view illustrating a state in which the cover part is re-coupled to the container inlet after the sealing member is separated.

FIG. 23*a* is a cross-sectional view before the separation part is separated, and FIG. 23*b* is a cross-sectional view illustrating a state in which the separation part is separated to be coupled to a fixing part.

MODE FOR CARRYING OUT THE INVENTION

Hereinafter, a container cap according to the present invention and a container (container assembly) to which the container cap is coupled will be described with reference to the accompanying drawings.

Figure 1:
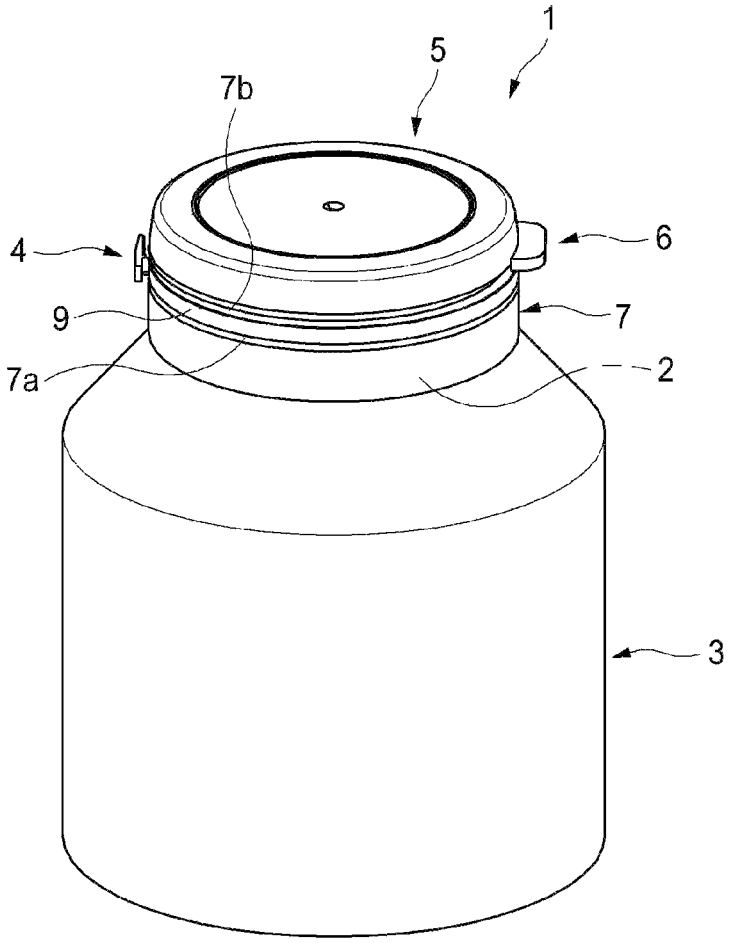
FIG. 1 is a perspective view illustrating a container to which a container cap is coupled according to the related art.
Figure 2:
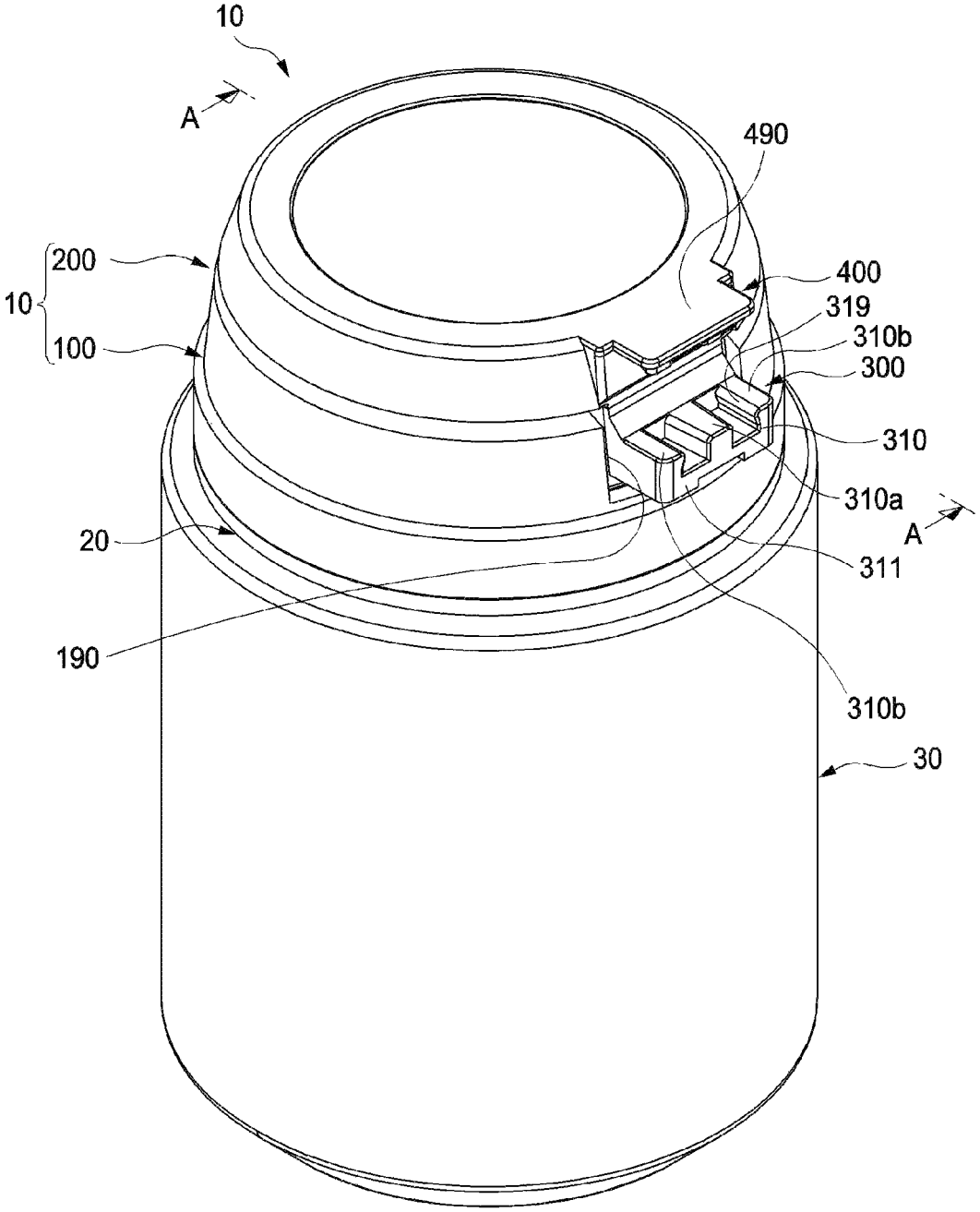
FIG. 2 is a perspective view illustrating a container to which a container cap is coupled according to a first embodiment of the present invention.

As shown in FIG. 2, the container 30 is a container that contains contents in the form of liquid materials, solid materials, especially particles and powder, and any configuration may be possible as long as the contents are contained, and also, a container inlet 20 through which the contents are discharged to the outside and to which the container cap 10 is coupled may be provided, and thus, any shape and structure may be possible.

Furthermore, the container 30 may contain contents that are provided in the form of granules or powder in consideration of coupling force of the container cap 10 according to the present invention and also may contain contents that are provided in a liquid phase.

In addition, in the container 30, a sealing member (not shown) may be coupled to an opening of the container inlet 20 to seal the container 30 in order to prevent deterioration of the contents before use, but in the case of the present invention, it is characterized by having sufficient sealing force even when no sealing member is installed.

An upper opening of the container inlet 20 may be a portion, through which the contents contained in the container 30 are discharged, and may have various planar shapes such as circular, oval, or polygonal shape, but it is desirable that the container inlet 20 has the circular shape when viewed at an upper side for stable coupling.

However, the planar shape of the container inlet 20 and the container cap 30 coupled thereto may be preferably circular, but it may have various shapes such as the polygonal shape such as a square shape.

In addition, the container inlet 20 may have various ring-shaped protrusions 21, 22, and 23 on outer and inner circumferential surfaces to be coupled and sealed with the container cap 10, which will be described later.

In addition, the container inlet 20 may have an outer diameter having various sizes, such as an outer diameter that is the same as the outer diameter of the container 30 or a relatively small outer diameter, as illustrated in FIGS. 2 to 4*c*.

In particular, in an embodiment of the present invention, the container inlet 20 may have a structure in which the inner diameter thereof decreases toward the upper opening.

The container cap 10 is coupled to the container inlet 20 to seal and open/close the container 30, and various configurations are possible.

Here, a material of the container cap 10 is plastic, and may be made of any material that is capable of being injected such as HDPE, PP, PET, PVC, or PS.

The container cap 10 may include a main body part 100 coupled to the container inlet 20 of the container 30 and a cover part 200 connected to a hinge part 530 with respect to the main body part 100 to open and close the main body part 100, i.e., the container inlet 20.

More specifically, as illustrated in the drawing, the container cap 10 may include a main body part 100 coupled to the container inlet 20 of the container 30 containing contents and having an opening defined at the upper side, and a cover part 200 integrally connected to the main body part 100 by a hinge part 530 to open and close the upper opening of the main body part 100.

The main body part 100 may be a configuration that is coupled to the container inlet 20 of the container 30 containing the contents and may have various configurations according to a coupling structure with the container inlet 20.

For example, the main body part 100 may have a ring shape corresponding to a horizontal cross-sectional shape of the container inlet 20 such as circular, oval, and polygonal shapes.

In addition, the main body part 100 may be screw-coupled to a male screw disposed on an outer circumferential surface of the container inlet 20. For this, a female screw that is screw-coupled to the male screw of the container inlet may be disposed on an inner circumferential surface of the main body part 100.

In addition, the main body part 100 may be provided with a fourth hook protrusion that is hooked with a third hook protrusion 21 disposed on an outer circumferential side of the container inlet 20 so as to be fixed to the container inlet 20.

The fourth hook protrusion 110 may be a ring-shaped hook protrusion disposed on the inner circumferential surface so as to be hooked with the third hook protrusion 21 disposed on the outer circumferential side of the container inlet 20 and fixed to the container inlet 20, and thus, any structure may be possible as long as it has a hook structure with the three hook protrusions 21.

In particular, the fourth hook protrusion 110 may be inclined downward from an upper side to an inner side.

Here, as illustrated in the drawing, in the third hook protrusion 21 of the container inlet 20, an end portion at a position corresponding to the fourth hook protrusion 110 may be densely disposed on an upper inclined surface of the fourth hook protrusion 110 in a state in which the main body part 110 is coupled to the container inlet 20.

Figure 3A:
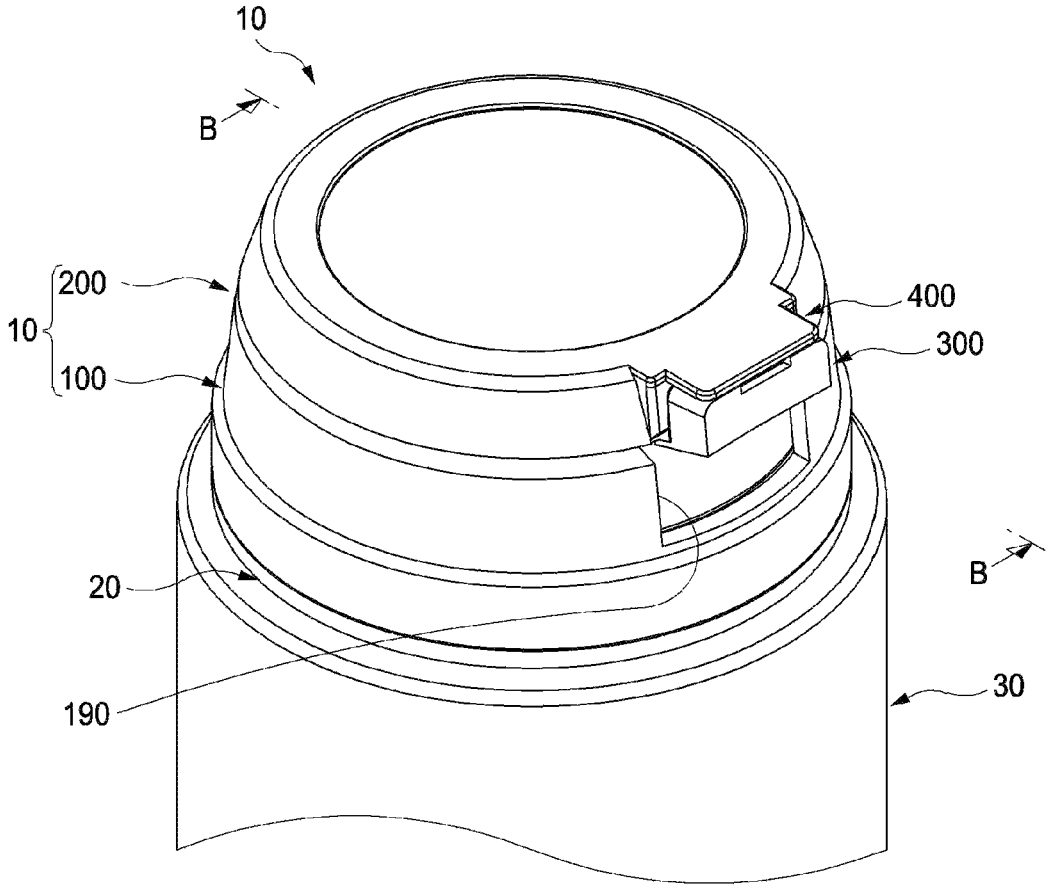
FIG. 3*a* is a partial perspective view illustrating a state in which a separation part and a fixing part are coupled to each other in the container cap of FIG. 2.
Figure 3B:
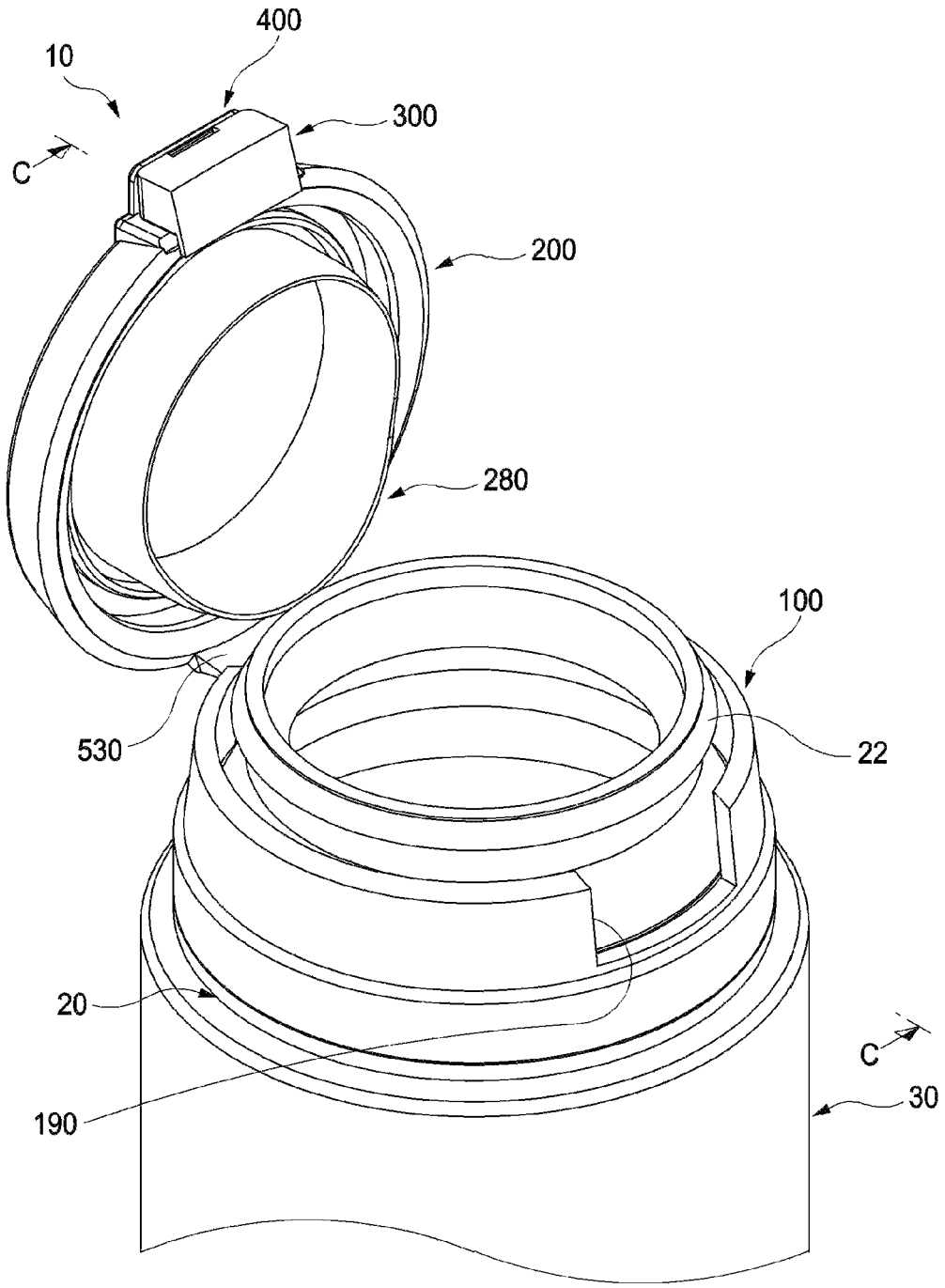
FIG. 3*b* is a partial perspective view illustrating a state in which a cover part is tilted in the state of FIG. 3*a*.

In addition, as illustrated in FIGS. 3*a* and 3*b*, the container inlet 20 may be provided with a concave part 21*a* that is concave as a thickness of a lower end of the main body part 100, and thus, in the state in which the main body part 100 is coupled, the outer circumferential surface of the container inlet 20 and the outer circumferential surface of the main body part 100 may provide a continuous surface.

The cover part 200 may be integrally connected to the main body part 100 by the hinge part 530 to open and close the upper opening of the main body part 100 by hinge rotation, and also, various configurations are possible.

Here, the hinge part 530 may be a portion that connects the main body part 100 to the cover part 200 to enable the hinge rotation with respect to the main body part 100 coupled to the container inlet 20, and may have various shapes and structures.

The cover part 200 may be coupled to the main body part 100 according to various conventional structures to close the upper opening of the main body part 100 so as to maintain the coupled state with the main body part 100 when the container 30 is not in use.

In addition, the cover part 200 may be coupled to a portion of an upper end of the container inlet 20 in addition to the coupling with the main body part 100.

Here, the cover part 200 may be preferably coupled to the upper end of the cover part 200 so as to be separated from the main body part 100 without rotation with respect to the container inlet 20.

Furthermore, it is preferable that the cover part 200 is coupled to the container inlet 20 by applying a blocking structure to be described later in order to prevent deterioration of the contents when being coupled to the upper end of the container inlet 20.

The main body part 100 and the cover part 200 may have a structure that is vertically cut except for the hinge part 530, and the hinge part 530 may have a band shape having a preset circumferential width in a circumferential direction to be integrally connected to the main body part 100 and the cover part 200.

Here, the hinge part 530 may be provided to be thinner than a thickness of each of the main body part 100 and the cover part 200 so as to be easily bent.

In addition, as illustrated in FIGS. 4*a* to 5*b*, the hinge part 530 may be provided with a cutoff part 532 that is cut by the width of the hinge part 530 toward the main body part 100 to enable the cover part 200 to rotate so as to be deeper toward the main body part 100.

That is, when the cover part 200 rotates with respect to the main body part 100, the thinnest portion may be preferably disposed at a position lower than an upper end of the main body part 100 so that a folded portion is folded at the position lower than the upper end of the main body part 100.

The container inlet 20 may be coupled to the cover part 200 in addition to being coupled to the main body part 100 and may be preferably coupled with a structure that increases in sealing force when coupled to the cover part 200.

Thus, in order to increase in the sealing force of the container 30, the cover part 200 may be provided with an inner ring 280 that protrudes from a bottom surface and is inserted into the inner circumferential surface of the container inlet 20.

In order to increase in the sealing force of the container 30, ring 280 may be configured to protrude from the bottom surface of the cover part 200 so as to be into the inner circumferential surface of the container inlet 20 and may have various shapes.

As illustrated in FIGS. 4*a* to 5*b*, the inner ring 280 may protrude downward from the bottom surface of the cover part 200 in a ring shape at a preset distance from the inner circumferential surface of the cover part 200.

Here, the inner ring 280 may have a thickness that is sufficient to be smoothly inserted into the inner circumferential surface of the container inlet 20, and a lower end of the inner ring 280 may decrease in thickness downward.

In addition, the container inlet 20 may be provided with a convex part 23 that is convex inward to be in contact with the inner circumferential surface of the inner ring 280 in the state in which the cover part 200 is coupled to the main body part 100.

The convex part 23 may be configured to seal the inside of the container 30 by being in contact with the outer circumferential surface of the inner ring 280 at the upper end of the container inlet 20 and may be provided as a convex curved surface.

When considering that the cover part 200 hingedly rotates by the coupling of the hinge part 590 with respect to the main body part 100, the inner ring 280 may further protrude at a portion thereof corresponding to the hinge part 510 than a portion thereof corresponding to the fixing part 400.

In particular, the inner ring 280 may be preferably provided to have a sufficient vertical distance at a portion corresponding to the hinge portion 590 so that, when the cover part 200 rotates by the hinge part 590 connecting the cover part 200 to the main body part 100, the outer circumferential surface of the inner ring 280 is rotatable at a predetermined angle in the state of being in contact with an upper end of the container inlet 20.

Thus, the inner ring 280 may include a first portion 281 provided at a preset angle by using the fixing part 400 as a center of an angle and having a constant vertical distance and a second portion 282 having a center of the hinge part 510 as the lowest point and having a vertical distance that increases downward from the first portion 281.

The first portion 281 may have a constant vertical distance so that a lower end thereof is horizontal, and the second portion 282 may have a center of the hinge part 510 as the lowest point so that a vertical distance thereof increases gently.

Here, the vertical distance of the first portion 281 may also gradually increase, or the vertical distance of the second portion 282 may also be constant in a certain section.

In addition, when the inner ring 280 is separated from the upper end of the container inlet 20 by the rotation of the cover part 200 and then coupled again, it may be desirable that elasticity and the folded portion of the hinge part 590 are determined so that the end of the inner ring 280 does not interfere with the insertion into the inner circumferential surface of the container inlet 20.

In order to increase in sealing force when the cover part 200 is coupled to the container inlet 20, the cover part 200 may be additionally provided with an auxiliary inner ring 293 that is in close contact with the inner circumferential surface at a position disposed further outward than the inner ring 280.

The auxiliary inner ring 293 may be a portion that extends downward from the bottom surface of the cover part 200 so as to be in close contact with the inner circumferential surface of the container inlet 30 to the outside of the inner ring 280 and may have a vertical distance that is relatively less than that of the inner ring 280 described above.

The inner ring 280, the auxiliary inner ring 293, etc. may be components for the sealing when coupled to the cover part 200 and the container inlet 20 and may be preferably provided at a thickness and made of a material that is capable of being elastically deformable.

The cover part 200 may be provided with a second hook protrusion 210 protruding toward the inner circumference so as to be hooked on the first hook protrusion 22 protruding toward the outer circumference near the upper end of the container inlet 20.

The first hook protrusion 22 may be a portion that protrudes on the outer circumference near the upper end of the container inlet 20 and may have a vertical cross-section shaped like a sharp horn.

Here, the first hook protrusion 22 may be disposed higher than the upper end of the main body part 100 in the state in which the main body part 100 is coupled so as to be easily coupled to the cover part 100.

The second hook protrusion 210 may be configured to be hooked on the first hook protrusion 22, which is described above, before being disposed on the inner circumferential surface of the cover part 200 so that the cover part 200 is coupled to the container inlet 20, and various configurations are possible.

In particular, the inner circumferential surface of the second hook protrusion 210 may be provided with an inclined portion 211 to which the end portion of the first hook protrusion 22 is in close contact with the inner circumferential surface.

Various modifications and embodiments of the upper end of the container inlet 20 and the cover part 200 may be possible to increase in sealing force to the container inlet 20.

Figure 9:
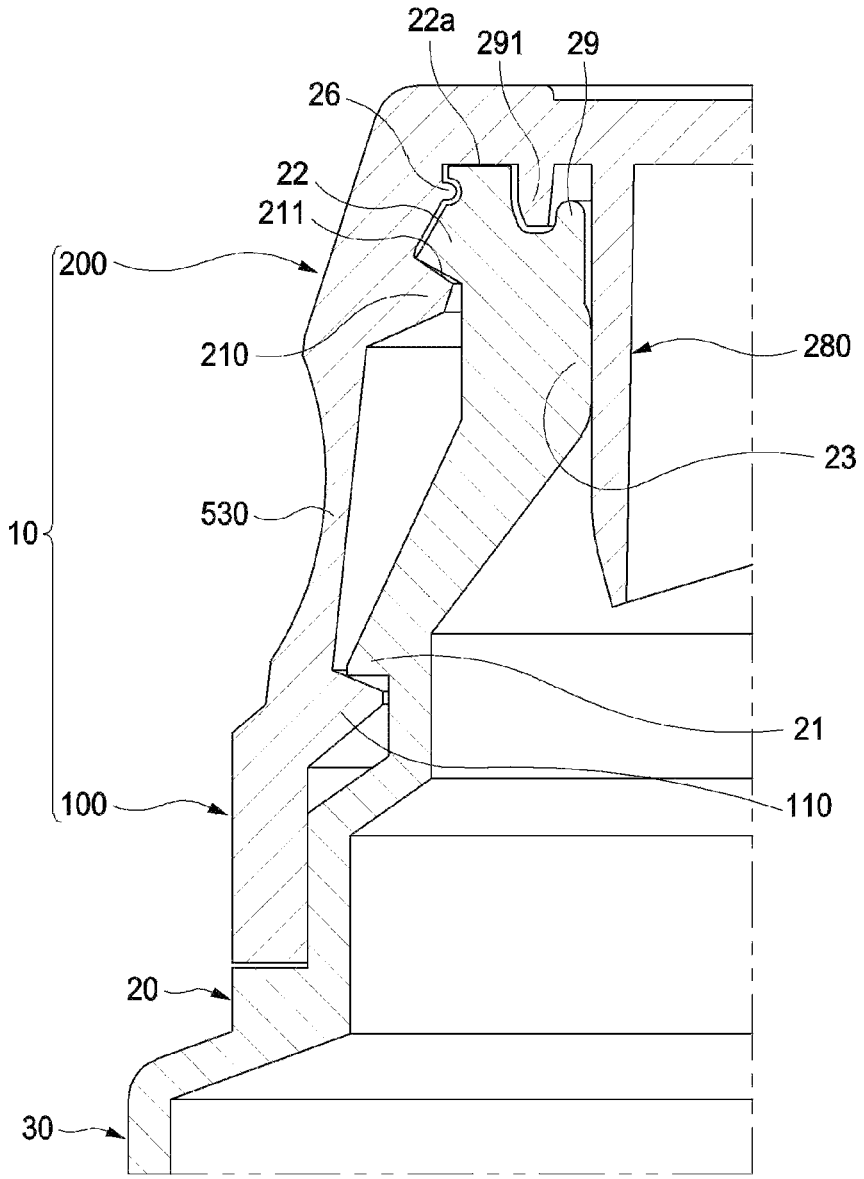
FIG. 9 is a partial cross-sectional view illustrating a coupling structure of a container inlet and a cover part of the container cap of FIG. 4*a* according to a first embodiment.

In a first embodiment, as illustrated in FIG. 9, the container inlet 20 may be provided with a ring-shaped upper concave groove 29 into which the previously described auxiliary inner ring 291 is inserted.

In addition, the container inlet 2 may have a ring-shaped hook concave groove 26 defined in the outer circumferential surface of the upper end so that the ring-shaped hook protrusion 220 protruding from the inner circumferential surface of the cover part 200 is inserted.

The hook protrusion 220 may be disposed above the second hook protrusion 210 described above and be a ring-shaped protrusion, and thus, the hook protrusion 220 together with the second hook protrusion 210 may improve coupling force between the cover part 200 and the container inlet 20.

The hook concave groove 26 may be a relatively concave portion defined in the outer circumferential surface of the container inlet 20 so that the hook protrusion 220 is inserted and may have a structure into which the hook protrusion 220 is inserted.

Figure 10A:
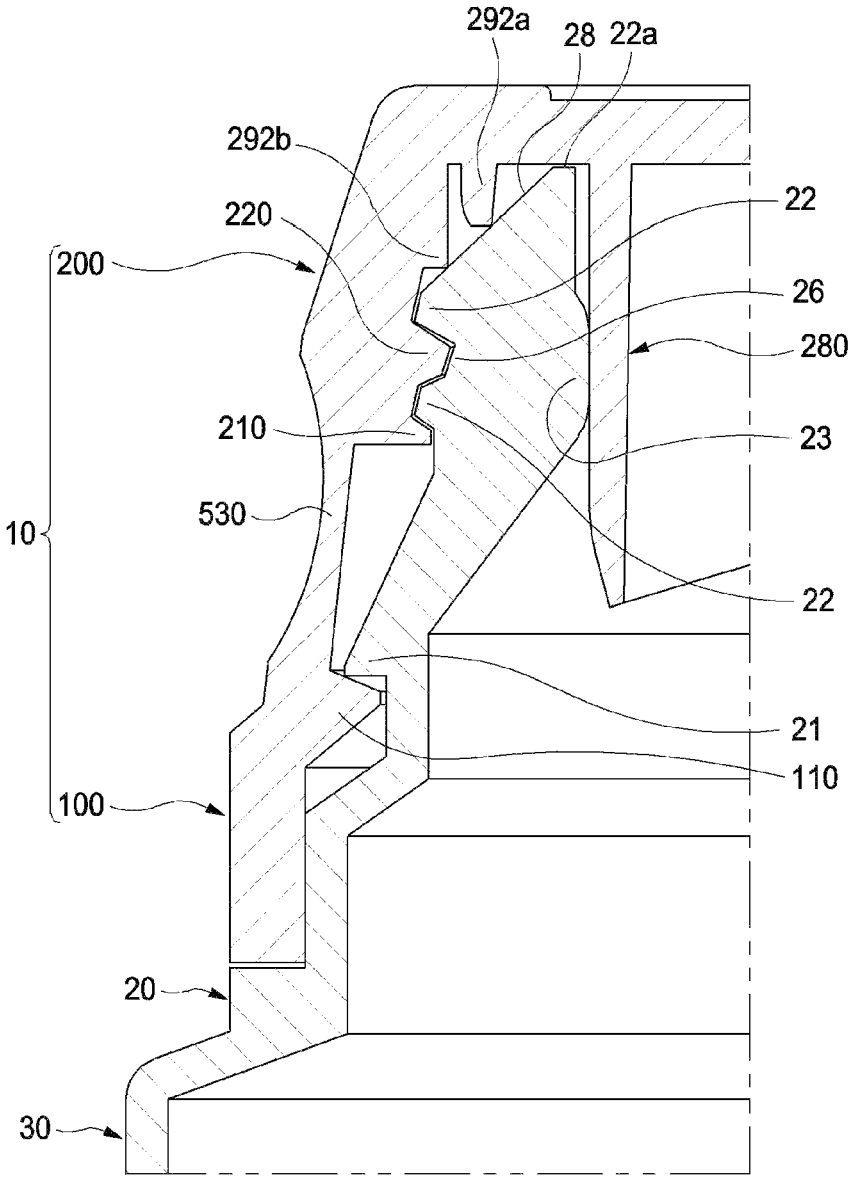
FIGS. 10*a* to 10*j* are partial cross-sectional views illustrating a coupling structure of the container inlet and the cover part of FIG. 4*a* according to second to ten embodiments.

In the second embodiment, as illustrated in FIG. 10*a*, the container inlet 20 may have a ring-shaped inclined surface 28 of which an outer diameter increases from an upper end on the outer circumferential surface, and the cover part 200 may be provided with at least one protrusion 292*a* or 292*b* having a ring shape, which is in contact with the inclined surface 28 in the state of being coupled to the container inlet 20.

The inclined surface 28 may be a portion disposed on the outer circumferential surface of the container inlet 20 so that the outer diameter increases from the upper end and may have various shapes such as a flat surface or a curved surface.

In addition, the protrusions 292*a* and 292*b* may be a configuration that protrudes from the cover part 200 and is in contact with the inclined surface 28 to isolate the inside and outside of the container 30, and the number of protrusions 292*a* and 292*b* may be determined according to the sealing force.

In addition, the protrusions 292*a* and 292*b* may have various shapes, such as being provided to protrude from the bottom surface or inner circumferential surface of the cover part 200, or being provided as stepped portions, as illustrated in FIG. 10*a*.

In the second embodiment, the container inlet 20 and the cover part 200 may have the structures of the hook protrusion 220 and the hook concave groove 26 according to the first embodiment.

Figure 10B:
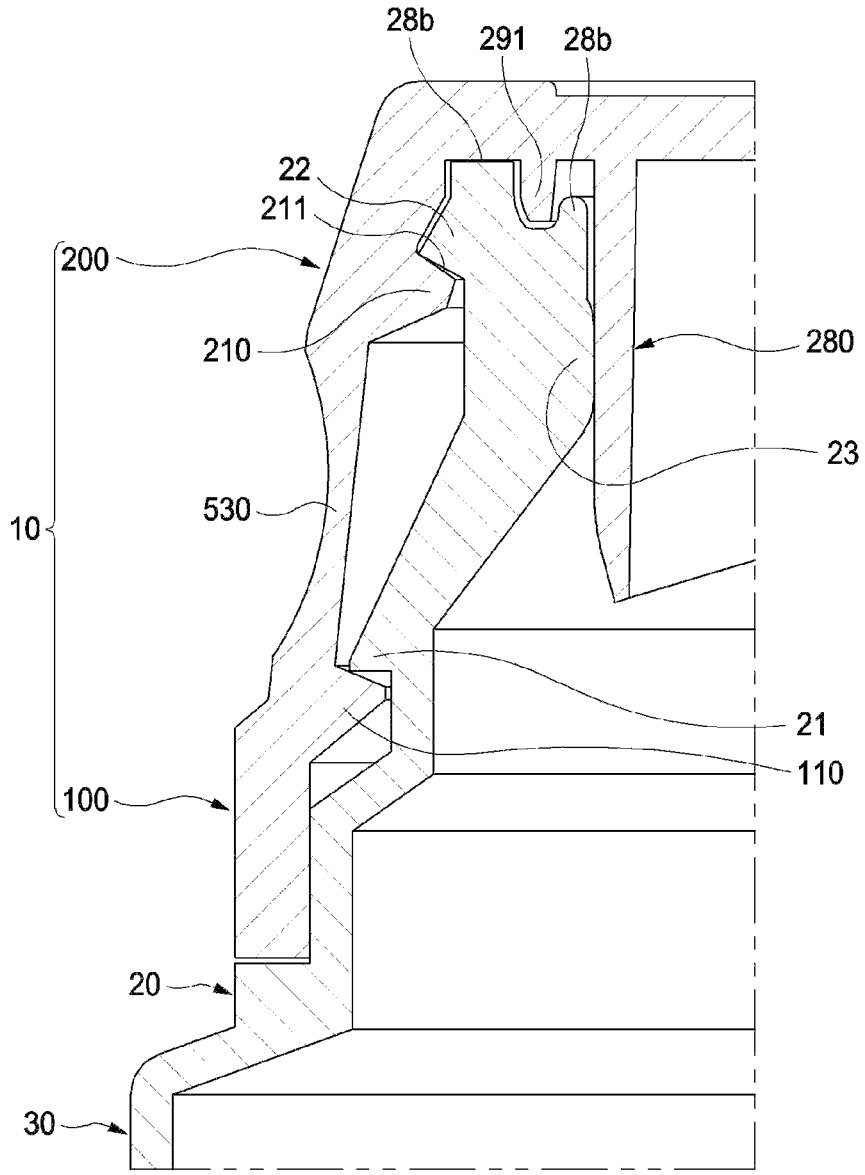

The third embodiment may be a modified example of the first embodiment, as illustrated in FIG. 10*b*, in the container inlet 20, a shape of the ring-shaped upper concave groove 29 into which the auxiliary inner ring 291 is inserted may be modified.

Specifically, an inner circumferential protruding portion 28*a* of the upper concave groove 29 may be defined lower than the outer circumferential protruding portion 28*b*.

In the third embodiment, the container inlet 20 and the cover part 200 may have the structures of the hook protrusion 220 and the hook concave groove 26 according to the first embodiment.

Figure 10C:
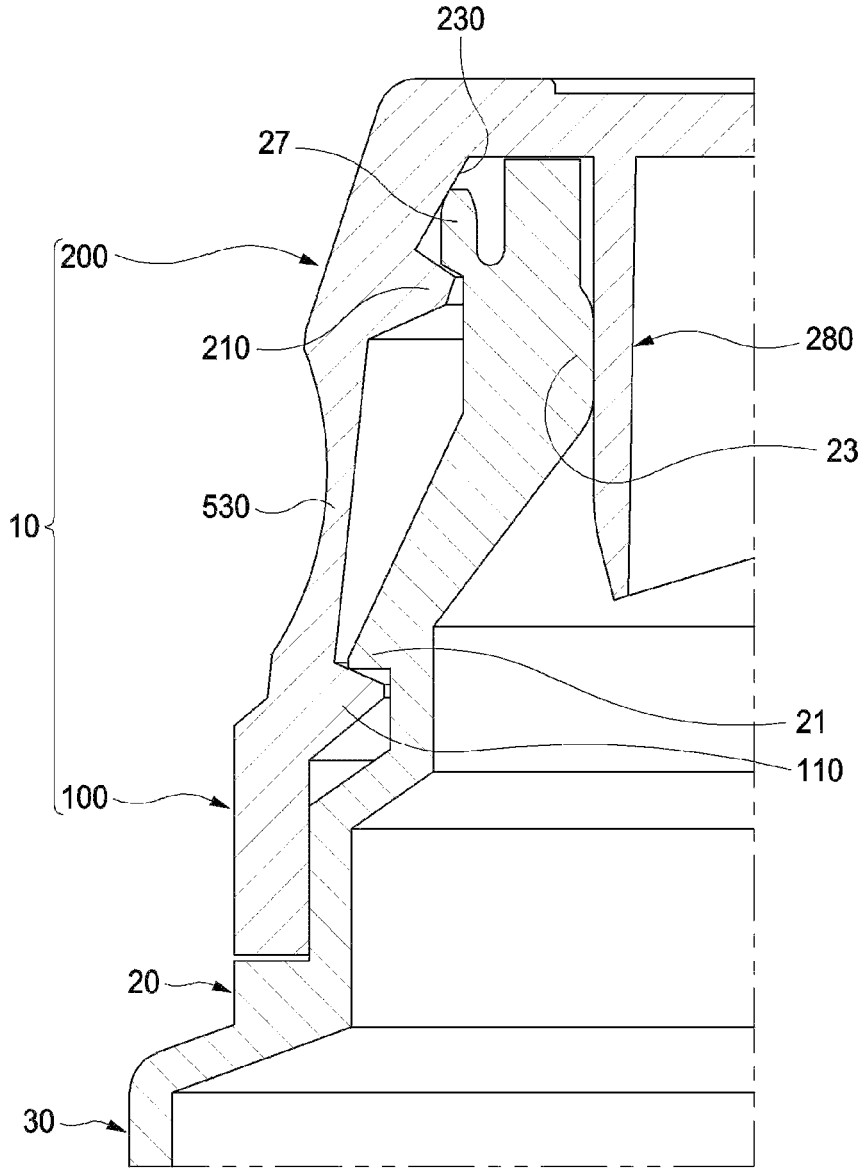

In the fourth embodiment, as illustrated in FIG. 10*c*, the cover part 200 may be provided with a ring-shaped inclined surface 230 connecting the bottom surface to the inner circumferential surface and also may be provided with one or more ring-shaped protrusions 27 that are in contact with the inclined surface 230 at the upper end of the container inlet 20.

Figure 10D:
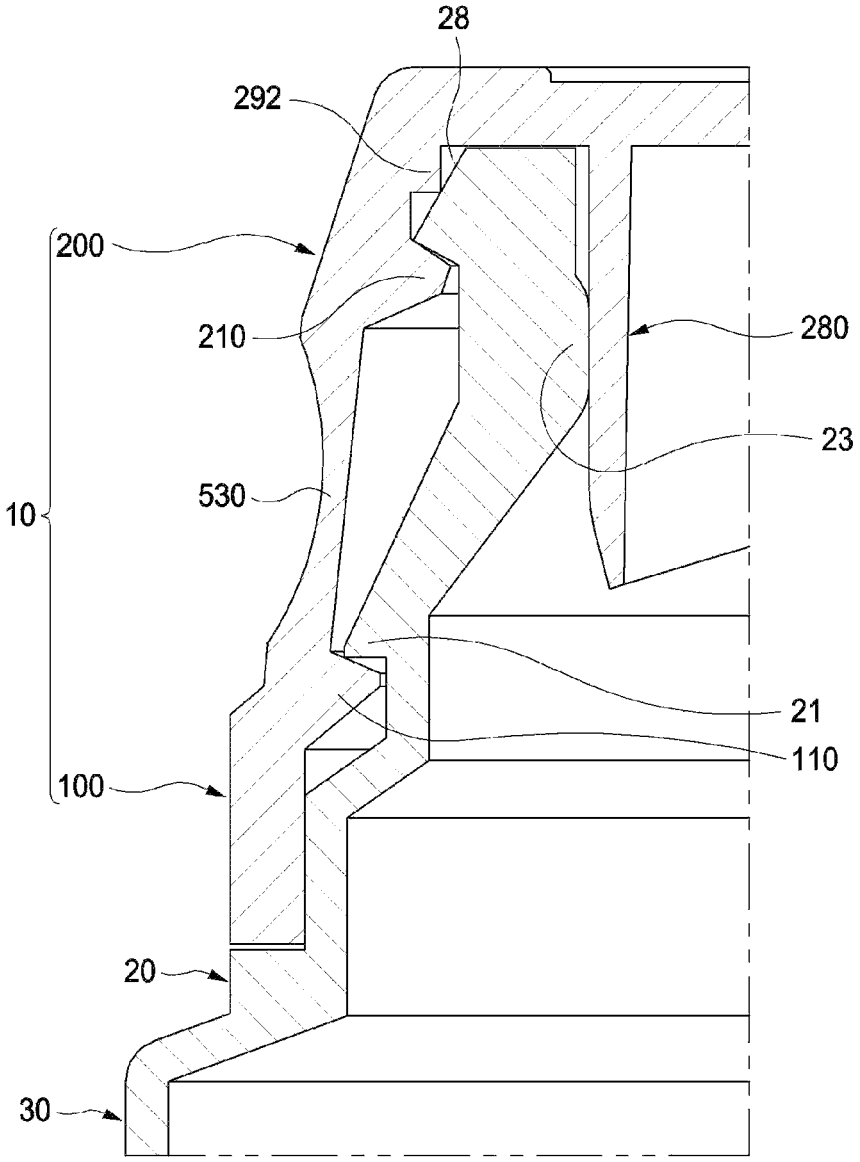

As illustrated in FIG. 10*d*, the fifth embodiment may be an opposite case of the fourth embodiment, in which a ring-shaped inclined surface 28 is disposed on the upper end of the container inlet 20, and one or more ring-shaped protrusions 272 that are in contact with the inclined surface 28 may be provided on the cover part 200.

Figure 10E:
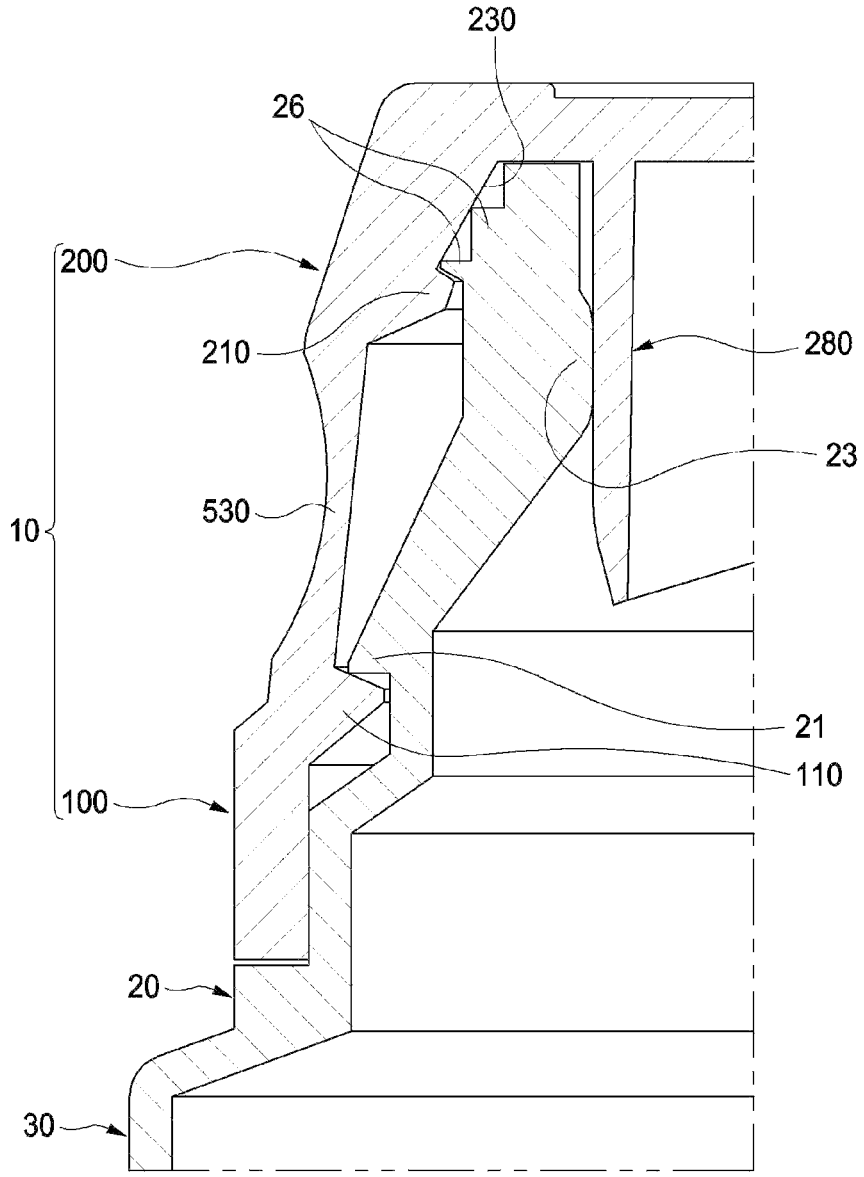

As illustrated in FIG. 10*e*, the fourth embodiment may be a modified example of the fourth embodiment, in which the cover part 200 is provided with a ring-shaped inclined surface 230 connecting the bottom surface to the inner circumferential surface and also is provided with one or more ring-shaped stepped protrusions 26 that are in contact with the inclined surface 230 at the upper end of the container inlet 20.

Figure 10F:
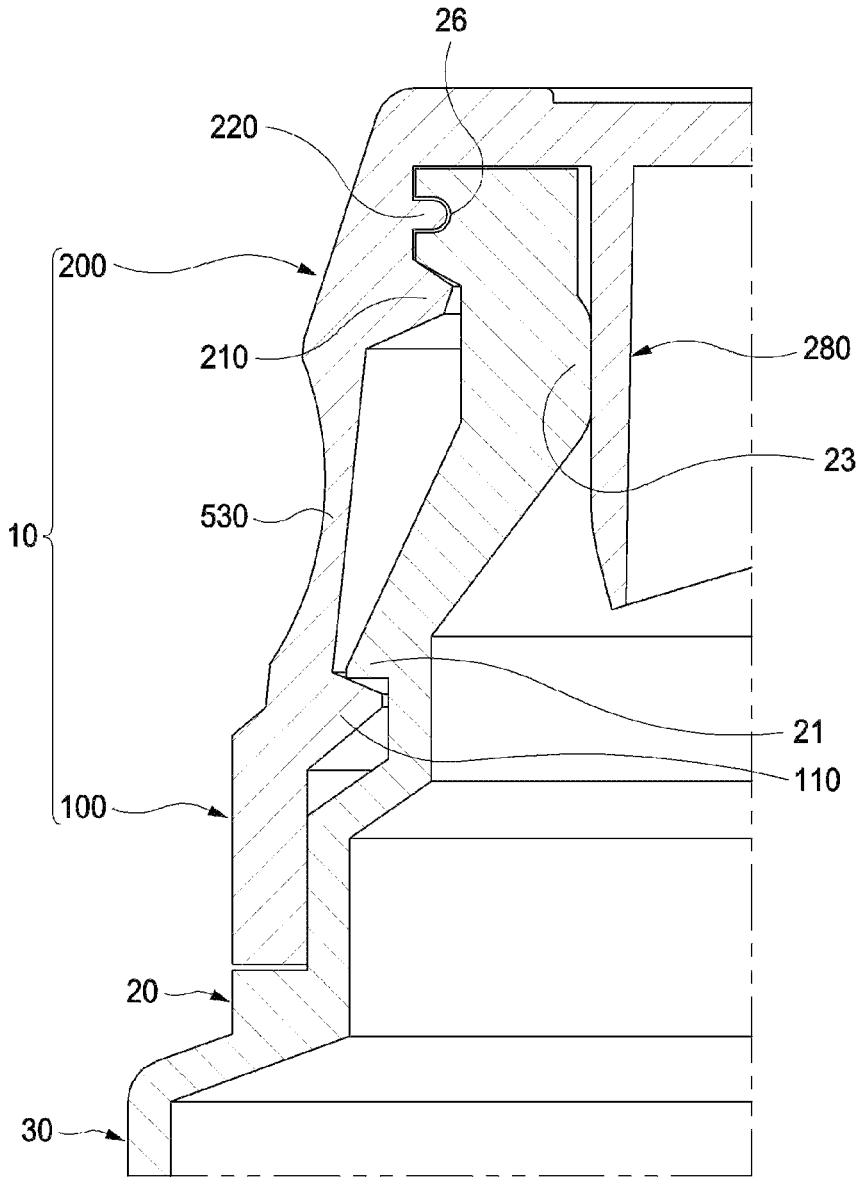

In the seventh embodiment, as shown in FIG. 10*f*, a depth of the hook concave groove 28 according to the first embodiment, that is, a depth from the outer circumference to the inner circumference may be greater than ½ of a width of the upper end of the container inlet 20.

In the eighth embodiment, as illustrated in FIGS. 10*g* to 10*j*, a ring-shaped inclined part 24 may be disposed on the inner circumferential surface of the container inlet 20, and the cover part 200 may be provided with one or more ring-shaped auxiliary inner rings 291 that are in contact with the inclined part 24.

Figure 10G:
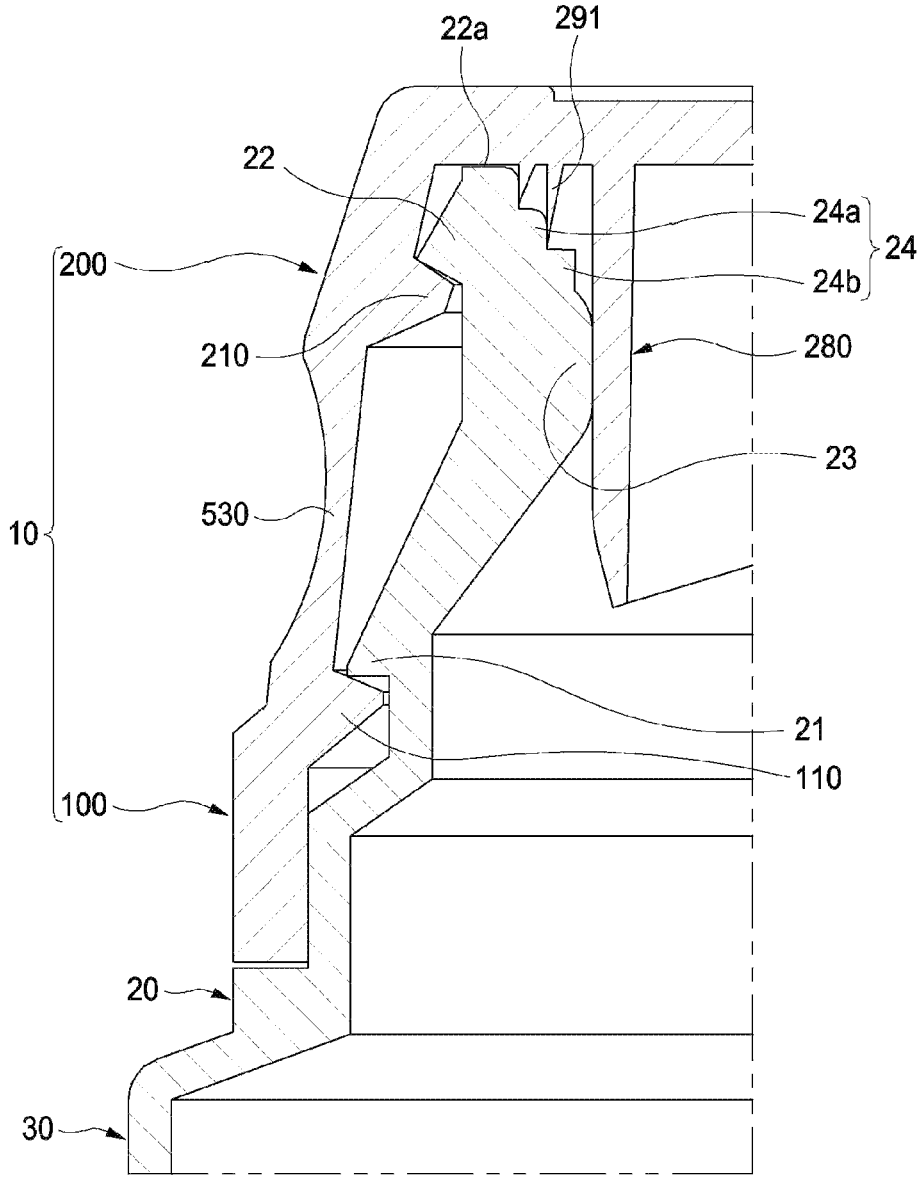

Specifically, as illustrated in FIG. 10*g*, the inclined part 24 constituted by a plurality of ring-shaped protrusions 24*a* may be provided to be inclined toward the inner circumferential surface of the container inlet 20, and one or more auxiliary inner rings 291 may be provided to be in contact with at least one of the plurality of ring-shaped protrusions 24*a*.

In particular, the auxiliary inner ring 291 may be provided to have a thin thickness and be bent in an inclined direction when being in contact with the plurality of ring-shaped protrusions 24*a* so as to be in close contact with the plurality of ring-shaped protrusions 24*a*, thereby sealing the container inlet 20.

Figure 10H:
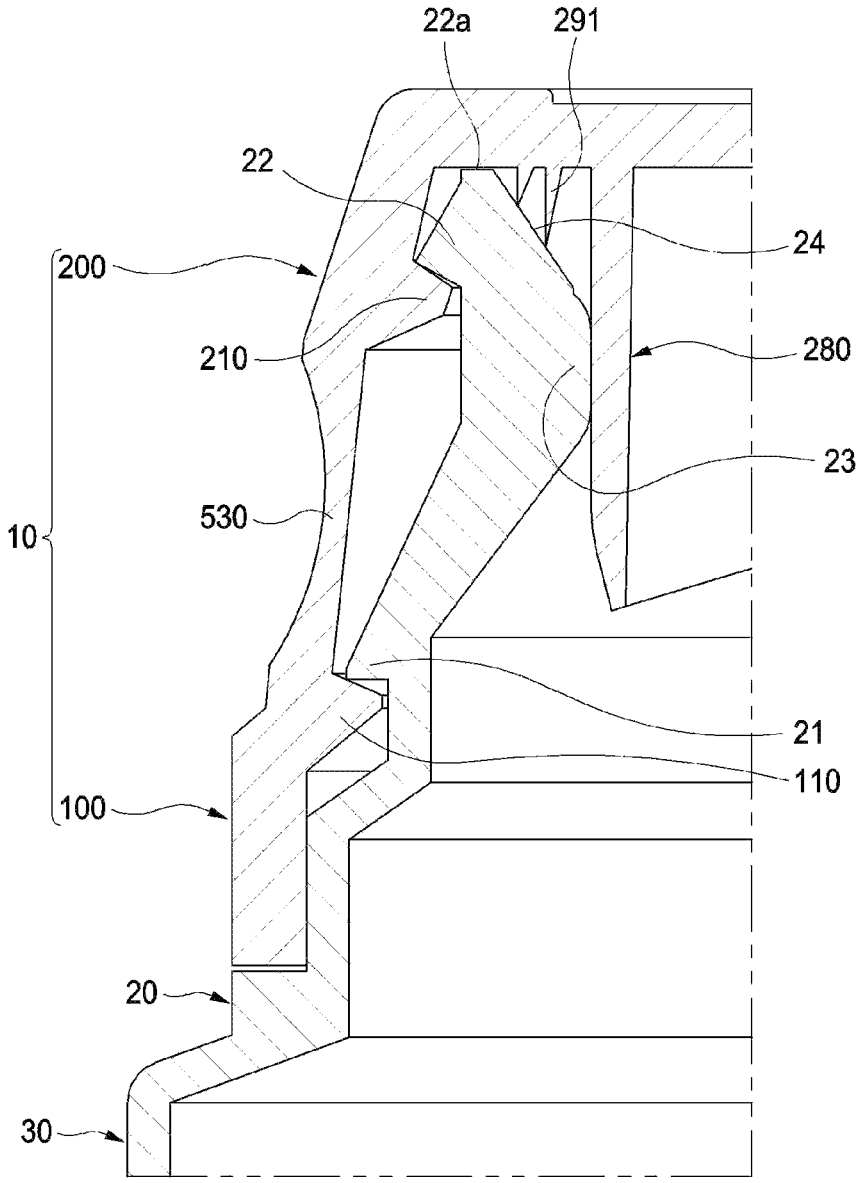

As illustrated in FIG. 10*h*, the inclined part 24 may be provided as a flat or curved surface, and one or more auxiliary inner rings 291 may be provided to be in contact with the inclined part 24.

Figure 10I:
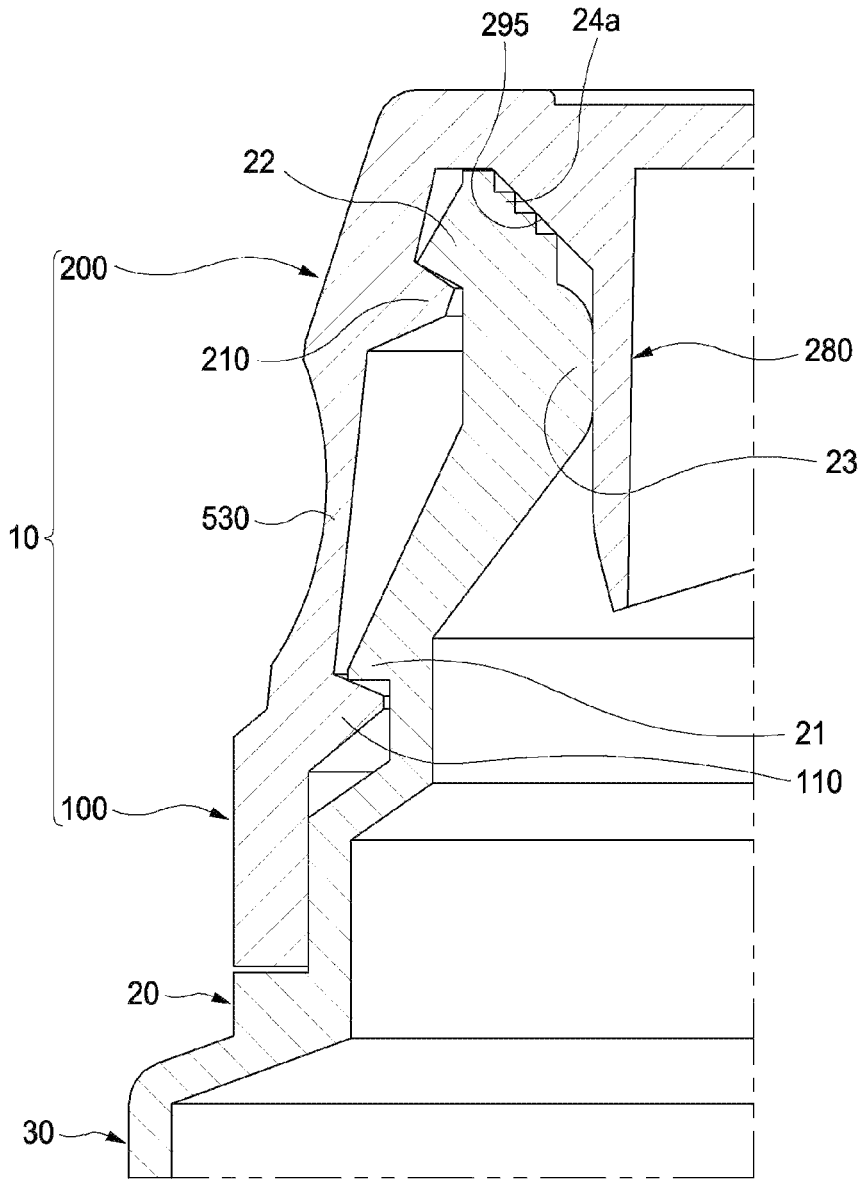

As a modified example of FIG. 10*g*, as illustrated in FIG. 10*i*, the cover part 200 may have the inclined part 24, that is, an inclined surface 295 that is in contact with the plurality of ring-shaped protrusions 24*a*.

Figure 10J:
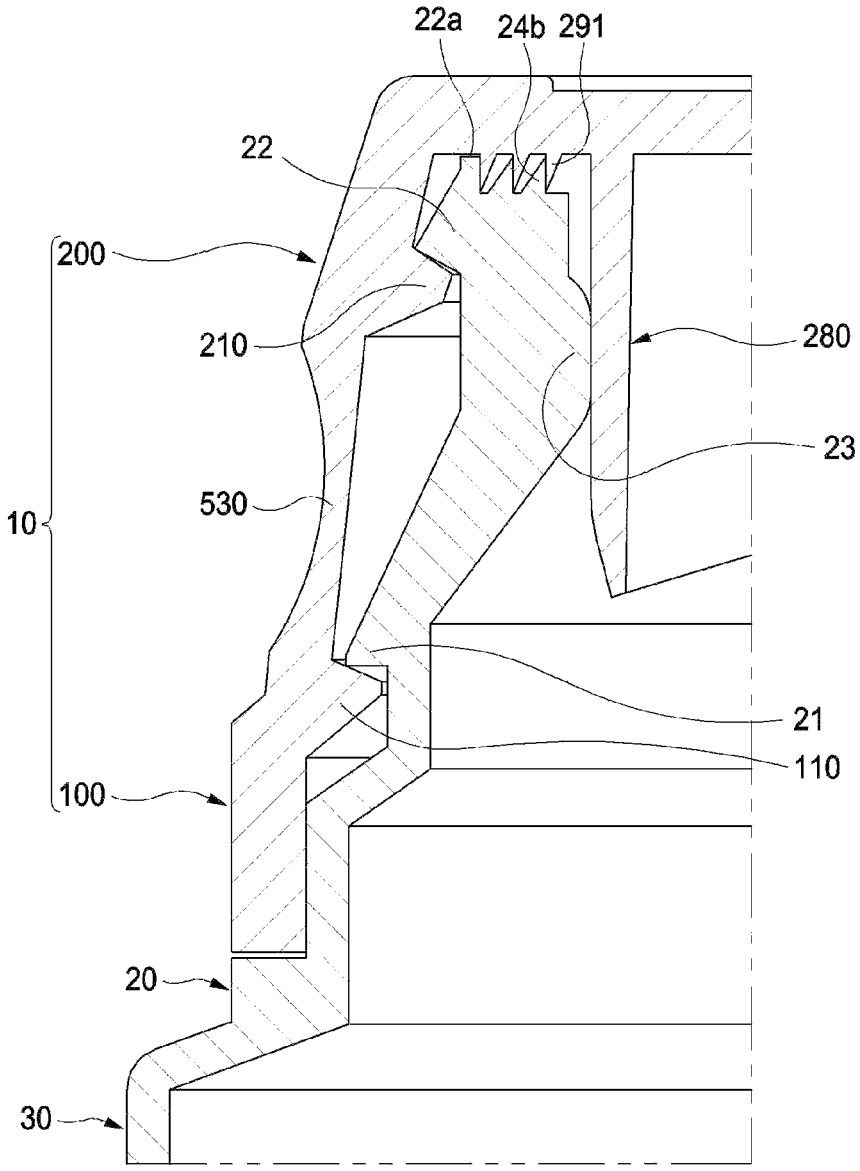

Lastly, as illustrated in FIG. 10*j*, the upper end of the container inlet 20 may be provided with a plurality of ring-shaped protrusions 24*a*, and the auxiliary inner ring 291 may be provided in one or more to be in contact with at least one of the plurality of ring-shaped protrusions 24*a*.

The coupling and sealing structure between the cover part 200 and the container inlet 20 may have a structure illustrated in FIGS. 27*a* to 34*c* in Patent Document 1.

In addition, the cover part 200 may be connected vertically by a separation line (not shown) or a plurality of bridges (not shown) with respect to the main body part 100 in consideration of the coupling force to the main body part 100 before being opened.

Figure 21:
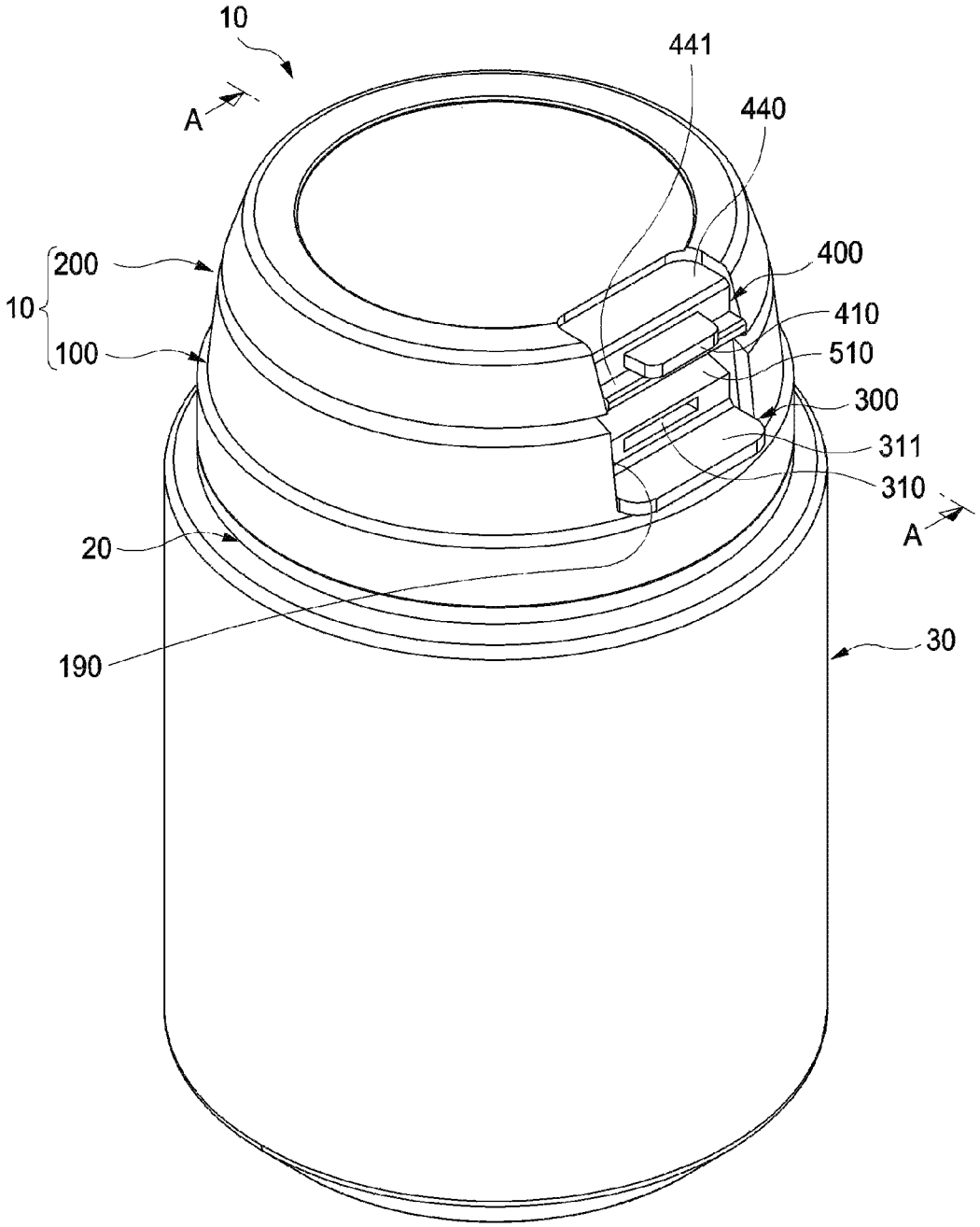
FIG. 21 is a perspective view illustrating a container cap according to the fifth embodiment of the present invention.
Figure 22:
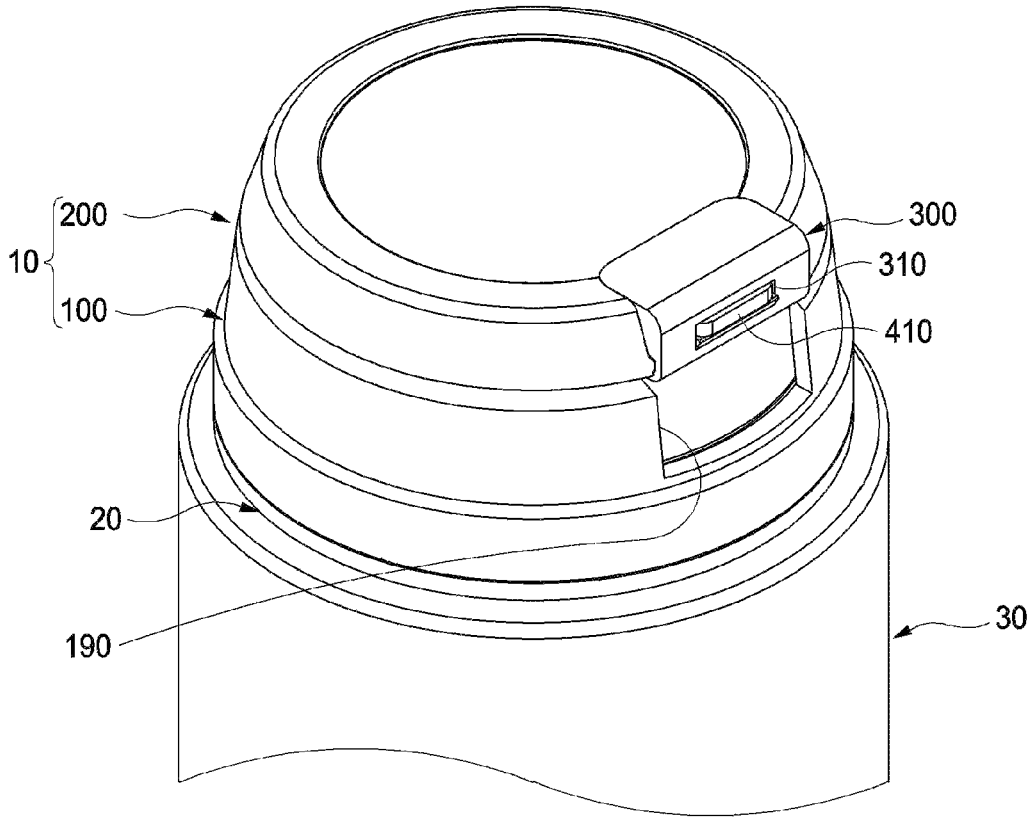
FIG. 22 is a perspective view illustrating a state in which a separation part is separated to be coupled to a fixing part in the container cap of FIG. 21.
Figure 23A:
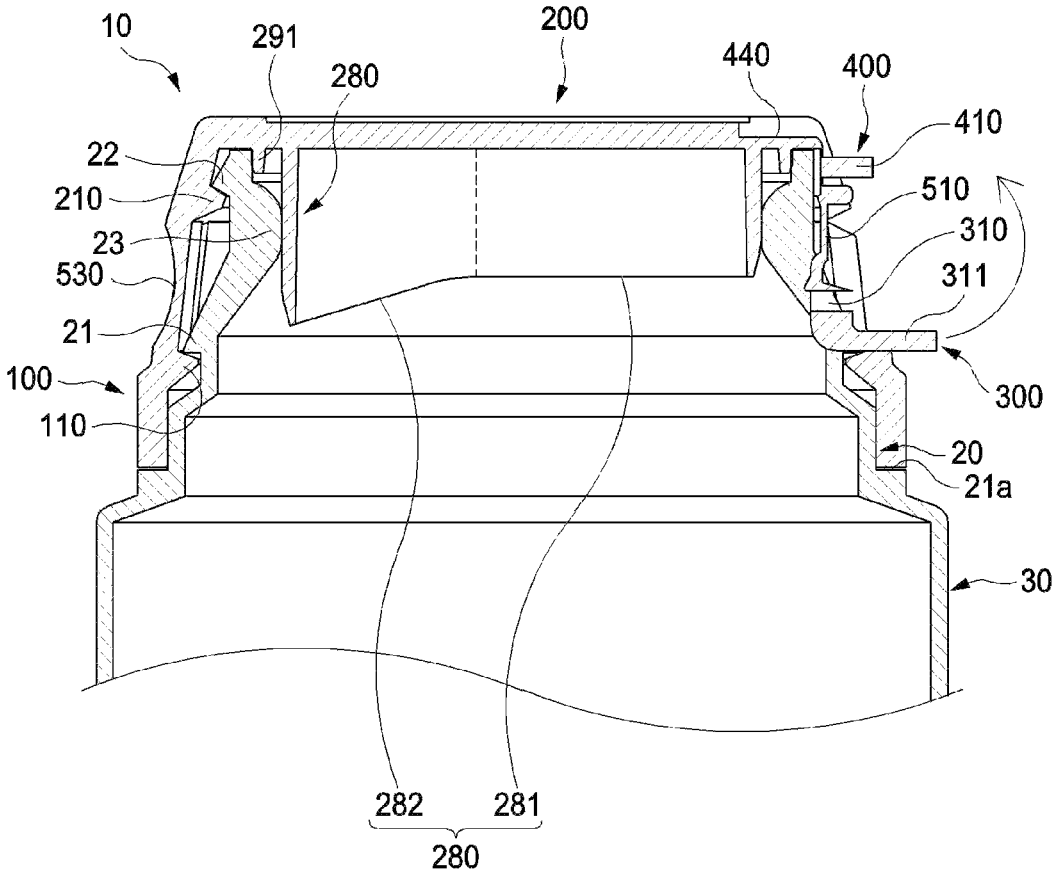
FIGS. 23*a* and 23*b* are cross-sectional views illustrating the container cap of FIG. 21.
Figure 23B:
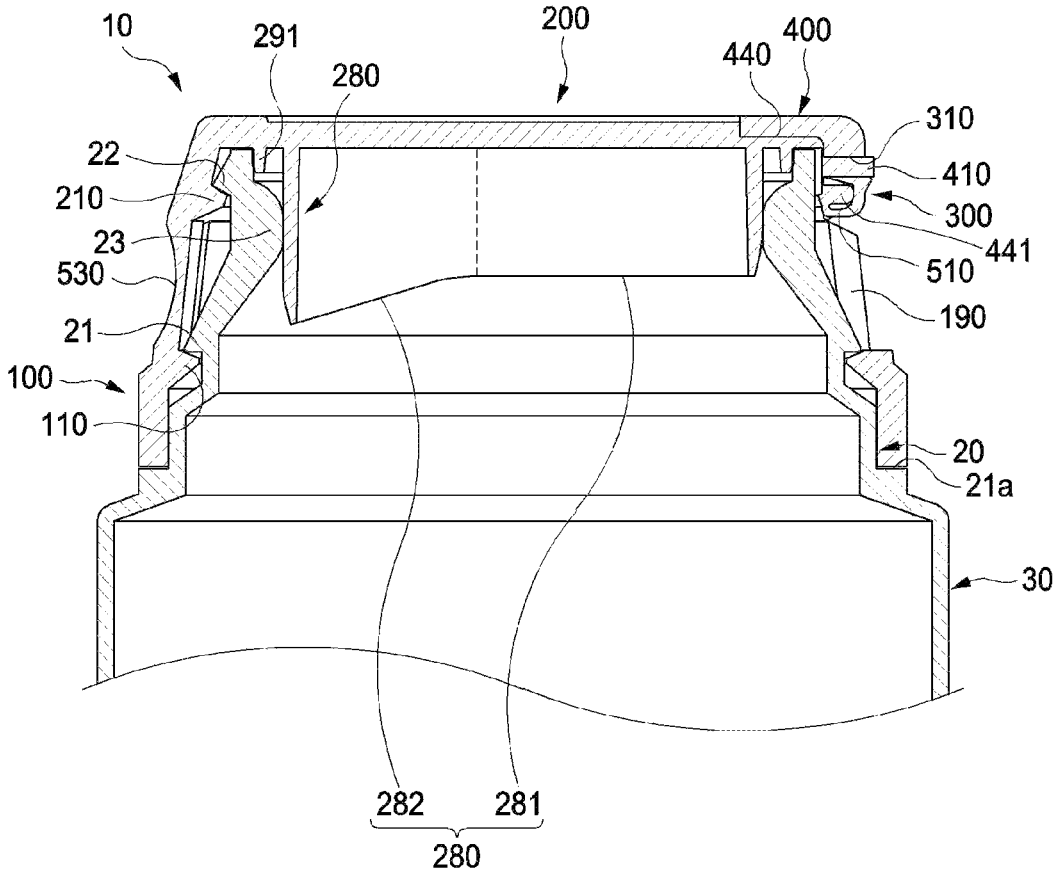

In addition, the cover part 200 may be coupled to the main body part 100 in the structure illustrated in FIGS. 21*a* to 21*c* in Patent Document 1 before being opened.

For this configuration, the hinge part 530 may be integrally formed as in the case of the injection molding of the cover part 200 and the main body part 100.

Separation Part and Fixing Part

As illustrated in FIGS. 2 to 8, the container cap 10 according to the present invention may include a separation part (300) that is integrally connected to the cover part 200 by the first connection part 510 and integrally separably connected to the main body part 100 by the second connection part 520 so as to determine whether the container cap 10 is opened and to open and close the container inlet 20, and a fixing part 400 disposed on the cover part 200 so that the second connection part 520 is fixed and coupled to the separation part 300 after being separated by the user's manipulation so that the cover part 200 is separated from the main body part 100.

The separation part 300 may be a configuration that is disposed on the cover part 200 so that the separation part 300 is fixed and coupled to the fixing part after being separated from the main body part 100 by rupturing the second connection part 520 by the user's manipulation, and various configurations are possible.

Specifically, the separation part 300 may be integrally connected to the cover part 200 by the first connection part 510 and be integrally separably connected to the main body part 100 by the second connection part 520, and various configurations are possible.

Here, the first connection part 510 may be a configuration that integrally connects the cover part 200 to the separation part 300 and may be preferably provided as a film (thin film) having a thickness less than that of a side surface of each of the cover part 200 and the main body part 100 in consideration of tilting of the separation part 300 after being separated.

An angle at which the separation part 300 is tilted may be set in various manners depending on the coupling structure with the fixing part 400. For example, various angles such as 90° may be set.

In addition, the first connection part 510 may have various widths so that a width of the first connection part 510 in a circumferential direction is less than or equal to that of the separation part 300.

The second connection part 520 may be a configuration that separably connects the main body part 100 to the separation part 300, and various configurations are possible.

Particularly, the second connection part 520 is characterized in that the second connection part 520 is ruptured by the user's manipulation so that the cover part 200 is separable from the body part 100.

Specifically, the second connection part 520 may have any configuration such as a cutting groove or a plurality of grooves so as to be easily ruptured by the user's manipulation as long as the second connection part 520 is separable by various manners such as easy separation, cutting, and the like by the user.

The second connection part 520 may be coupled to various structures and positions according to the formation structure of the separation part 300 and the main body part 100.

For example, the second connection part 520 may be connected horizontally and/or vertically along an edge of the separation part 300.

In summary, the second connection part 520 may be a configuration that connects the separation part 300 to the main body part 100 during integrated injection molding of the main body part 100 and the cover part 200, and may be a portion that is ruptured when the user's manipulation is performed, i.e., the separation part 300 is pressed upward and also may be provided as one or more bridges each of which has a relatively thin width and thin thickness.

Figure 6A:
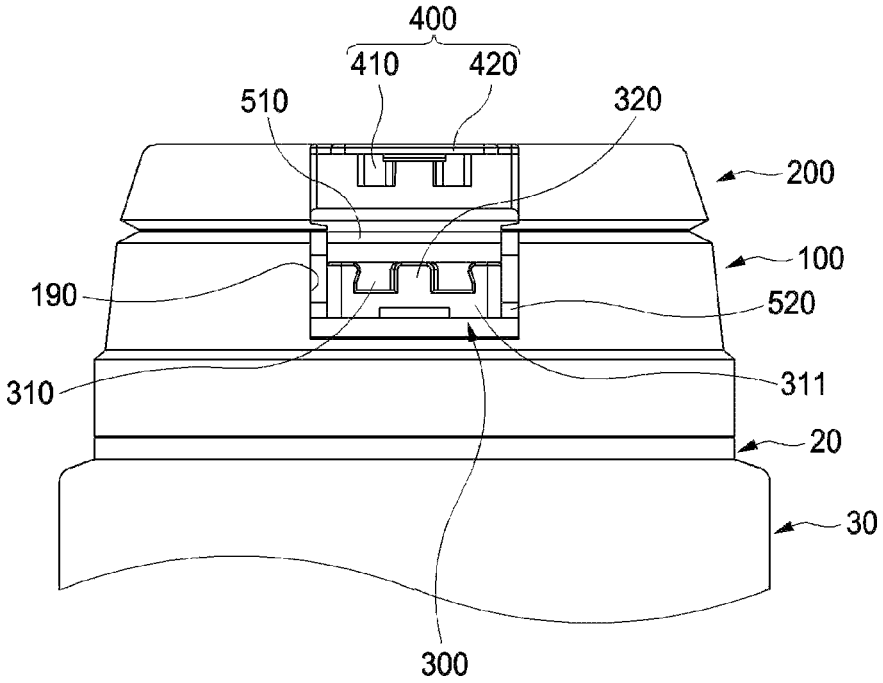
FIG. 6*a* is a front view illustrating the state in FIG. 2.

In addition, a formation position of the second connection part 520 may be defined at an appropriate position in consideration of stable coupling state and rupture of the separation part 300 with respect to the main body part 100, as illustrated in FIG. 6*a*, when the separation part 300 is viewed from the front, the second connection part 520 may be disposed on each of both edges.

In relation to the formation of the separation part 300, the main body part 100 may be provided with a cutoff part 190 corresponding to the outer circumferential shape of the separation part 300, and the second connection part 520 may be provided in one or more to be connected between an edge of the separation part 300 and an inner circumference of the cutoff part 190.

In particular, the cutoff part 190 may be provided at a size corresponding to an outer appearance of a front surface of the separation part 300 near a boundary at which the main body part 100 and the cover part 200 are in contact with each other.

The separation part 300 may be provided with one or more concave parts 310 when viewed from above in the state of being connected to the main body part 100.

Here, the fixing part 400 may be provided with a protrusion 410 fitted into the concave part 310 of the separation part 310 by separating and tilting the separation part 300 from the main body part 100 to correspond to the concave part 310 so as to be coupled to the separation part 300.

When the separator 300 is separated from the main body part 100 and then coupled to the fixing part 200, a space for easy manipulation by user's fingers may be defined below the separator 300 coupled to the fixing part 200.

The concave part 310 and the protrusion 410 may correspond to each other and be provided as a pair.

Figure 6B:
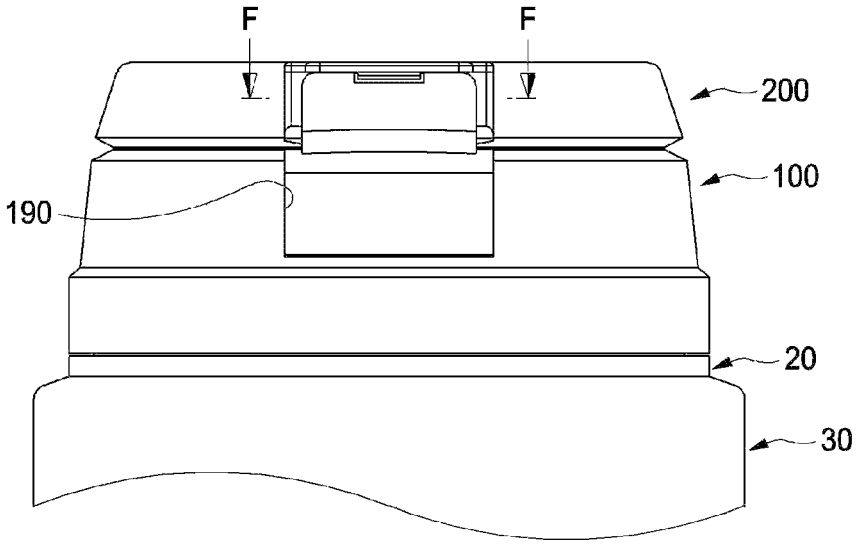
FIG. 6*b* is a front view illustrating the state in FIG. 3*a*.
Figure 7:
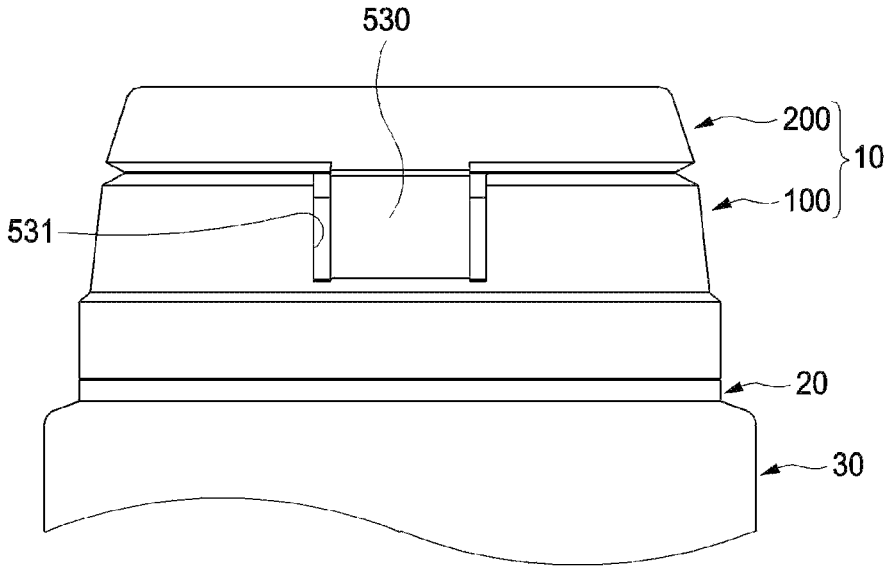
FIG. 7 is a rear view illustrating the states in FIGS. 2 and 3*a*.
Figure 8:
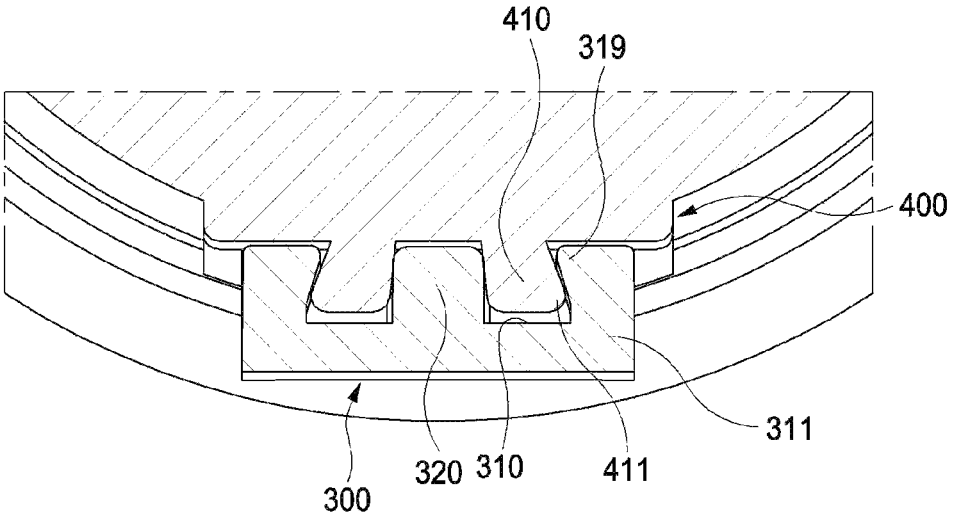
FIG. 8 is a cross-sectional view in a direction F-F in FIG. 6*b*.

As illustrated in FIGS. 6*a*, 6*b*, and 8, the concave part 310 may have a narrow inlet portion based on the insertion direction, and the protrusion 410 may have a greater width at an end thereof to correspond to the inlet portion of the concave part 310.

That is, as illustrated in FIG. 8, the concave part 310 may be provided with a first convex part 319 that protrudes further from a central portion toward an outer portion when viewed from above, and the protrusion 410 may be provided with a second convex part 411 that faces the first convex part 319 of the concave part 310 to further protrude.

In addition, the concave part 310 may be relatively formed by a central protrusion 310*a* protruding upward when viewed from above in the state in which the separation part 300 is coupled to the fixing part 100 and a pair of outer protrusions 310*b* disposed at an interval by using the central protrusion 310*a* as a center.

The central protrusion 310*a* may have a trapezoidal shape with a narrow end when viewed from above in the state in which the separation part 300 is coupled to the fixing part 100.

The protrusion 410 of the fixing part 400 may be a portion that is inserted into the concave part 310 of the separation part 300 by separating and tilting the separation part 300 from the main body part 100 and may have various shapes.

The protrusion 410 may be disposed at a position corresponding to the concave part 310 when the separation part 300 is folded and may be provided with an insertion concave groove that is relatively defined at a position at which the central protrusion 310*a* is inserted.

As illustrated in FIG. 8, the insertion convex groove may have a trapezoidal shape that is gradually narrowed toward the outside.

In addition, the protrusion 410 may be preferably provided in a shape that is narrow in width as it moves upward with respect to a longitudinal direction of the container inlet 20, that is, the longitudinal direction of the container cap 10.

Figure 4A:
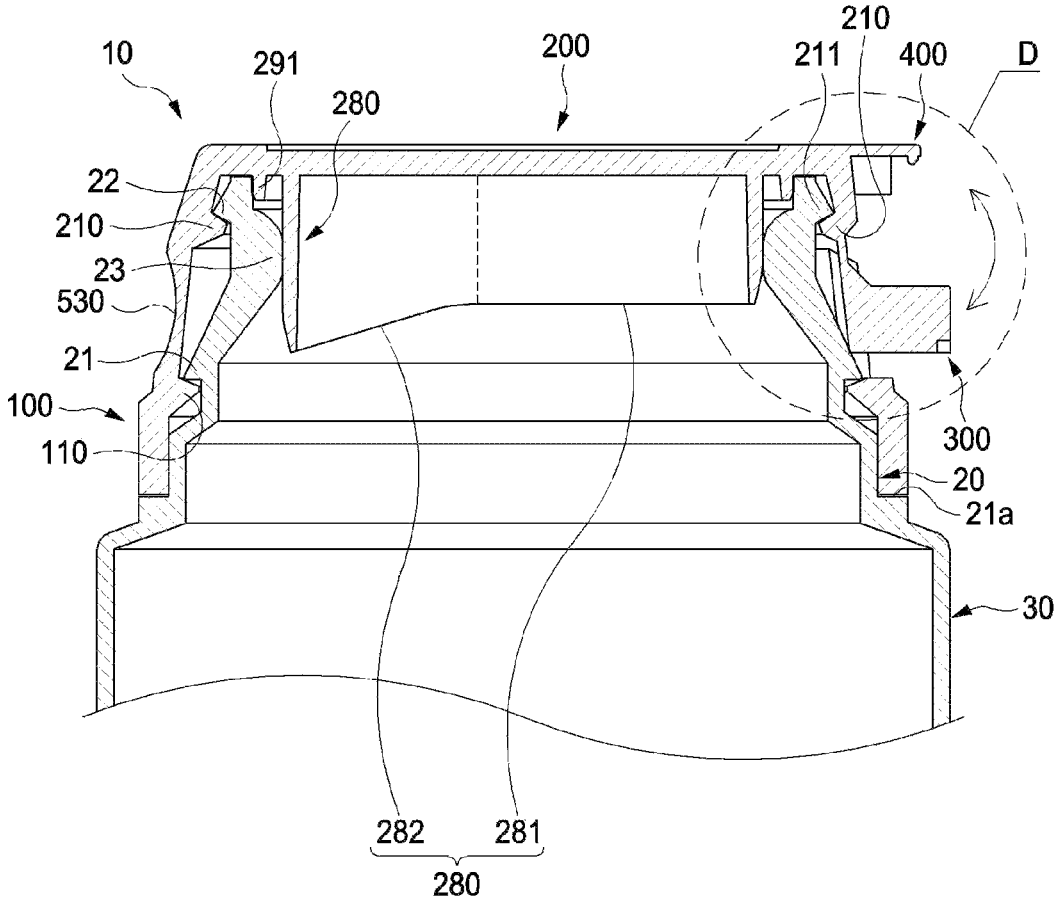
FIG. 4*a* is a cross-sectional view taken along line A-A in FIG. 2.
Figure 4B:
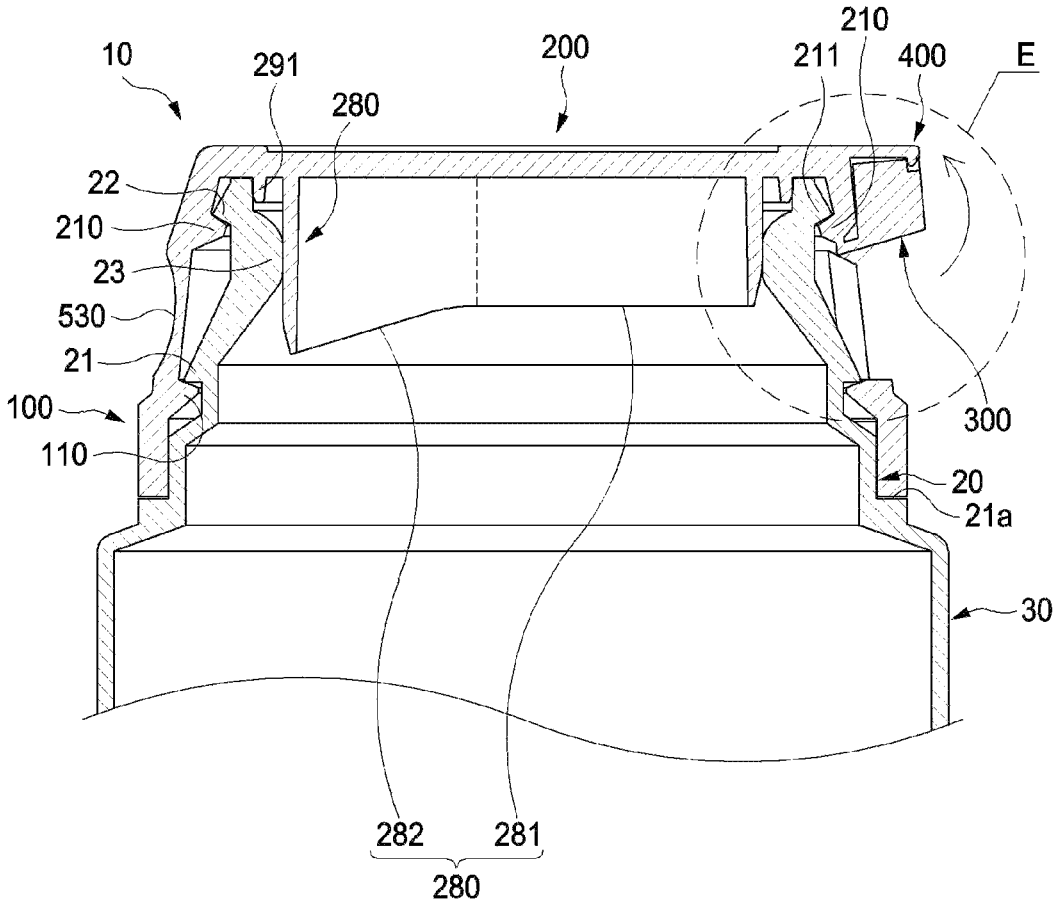
FIG. 4*b* is a cross-sectional view taken along line B-B in FIG. 3*a*.
Figure 4C:
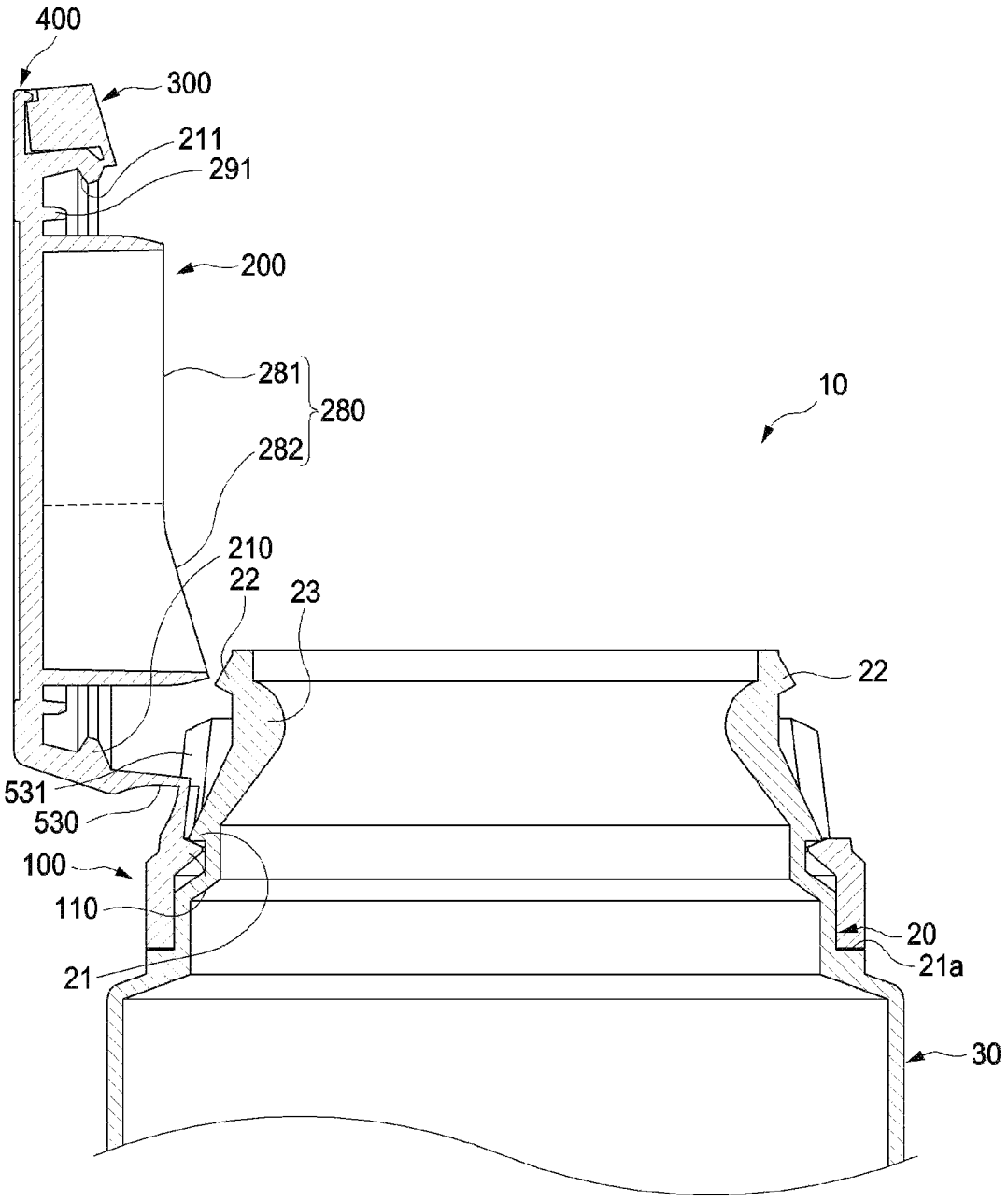
FIG. 4*c* is a cross-sectional view taken along line C-C in FIG. 3*b*.
Figure 5A:
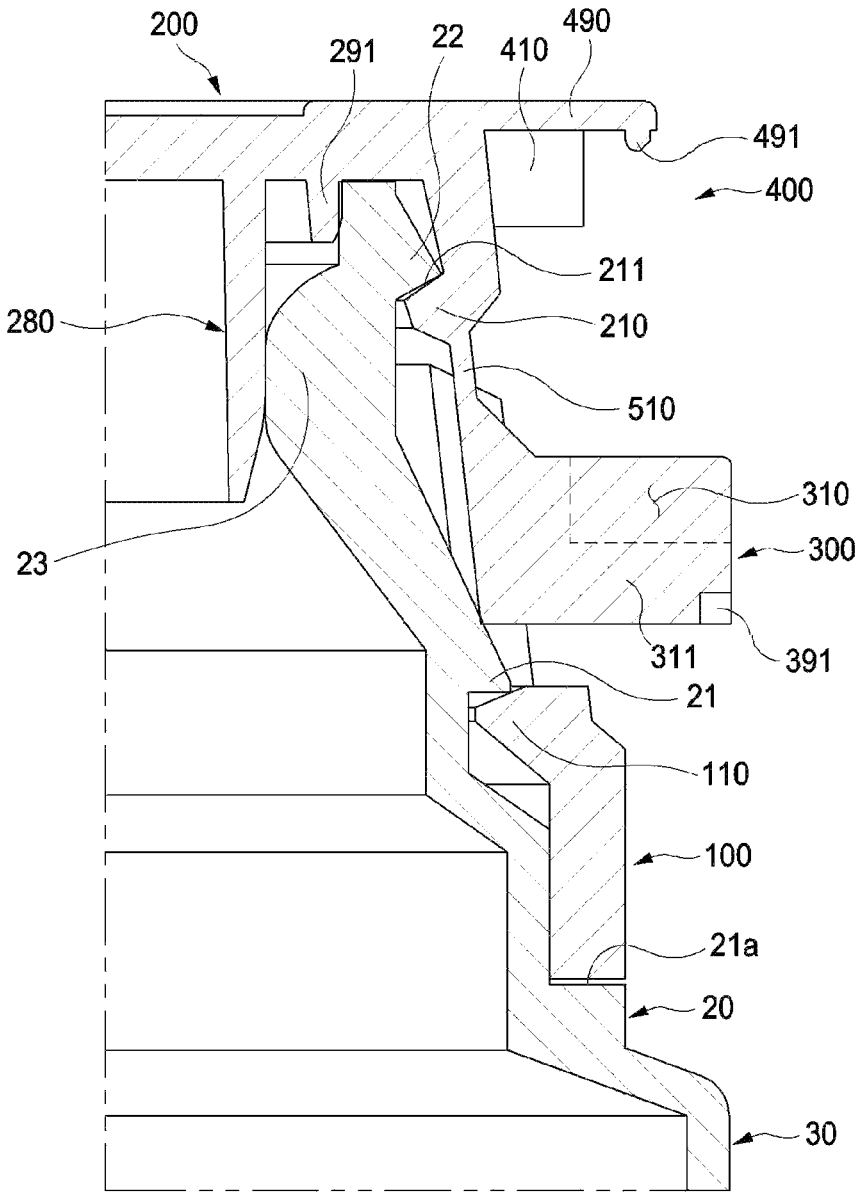
FIG. 5*a* is an enlarged cross-sectional view of a portion D in FIG. 4*a*.
Figure 5B:
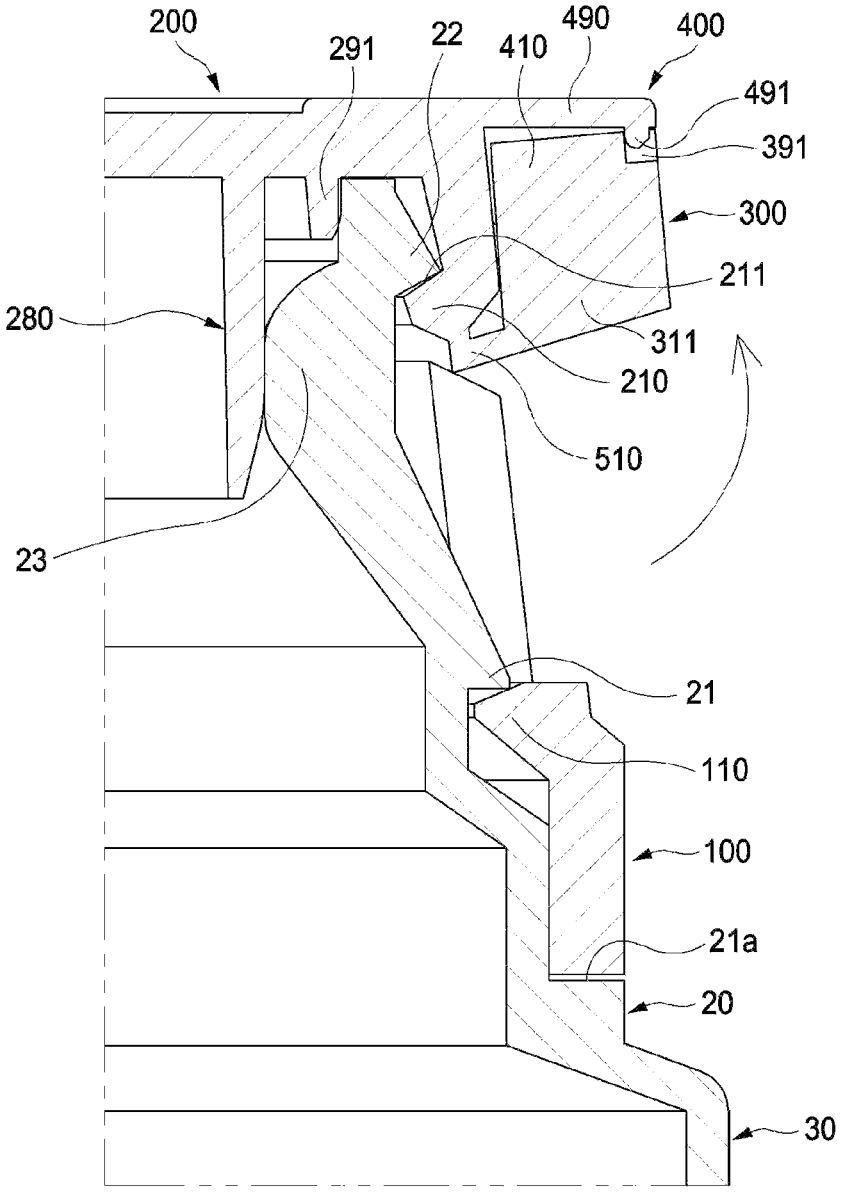
FIG. 5*b* is an enlarged view of a portion E in FIG. 4*b*.

As illustrated in FIGS. 4*a* to 4*c*, the separation part 300 may be provided so that a lower end 311 protrudes further outward from the outer circumferential surface of the main body part 100 to facilitate the user's manipulation.

That is, the above-described concave part 310 of the separation part 300 may be naturally formed by a portion that protrudes further outward from the outer circumferential surface of the main body part 100.

Figure 11A:
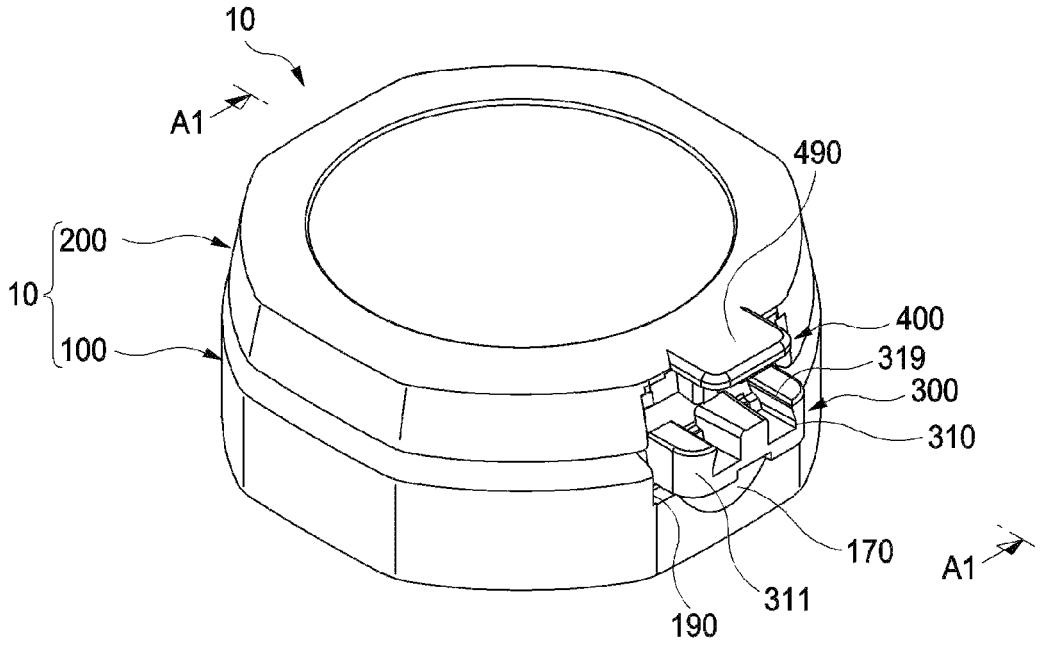
FIGS. 11*a* and 11*b* are perspective views illustrating a container to which the container cap is coupled according to the second embodiment of the present invention.
Figure 11B:
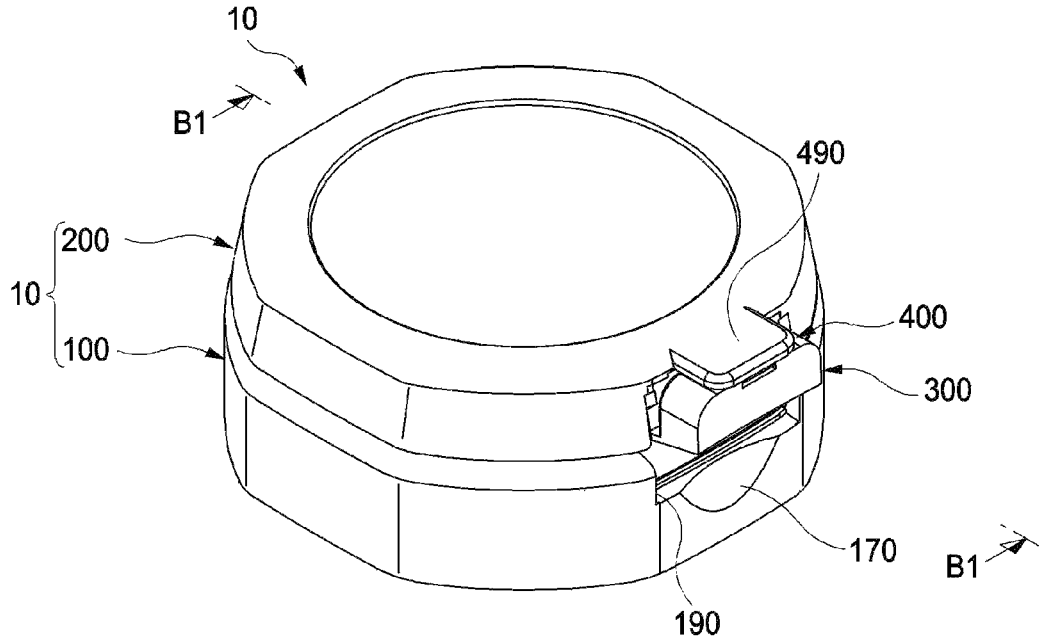
Figure 12A:
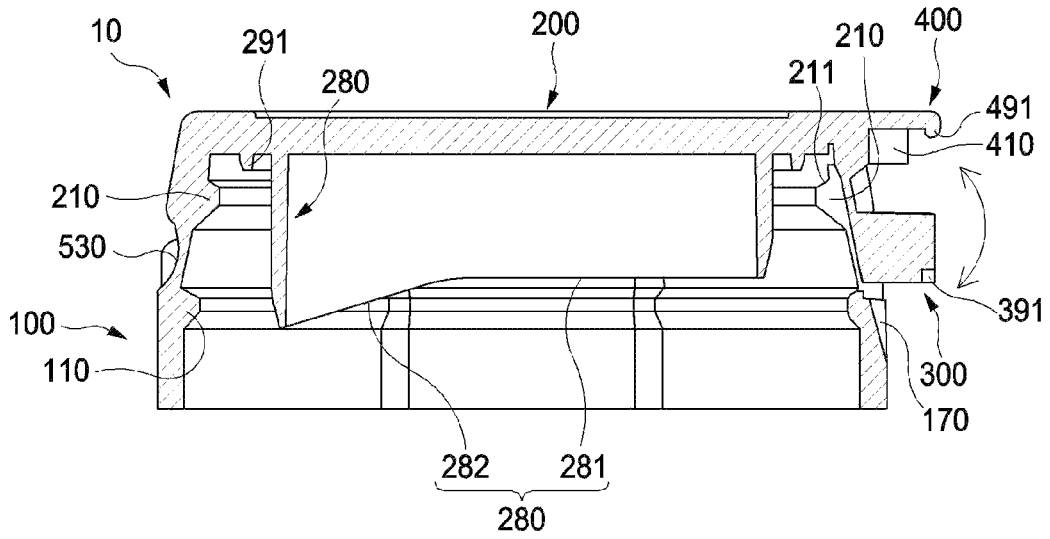
FIG. 12*a* is a cross-sectional view in a direction A-A1 in FIG. 11*a*.
Figure 12B:
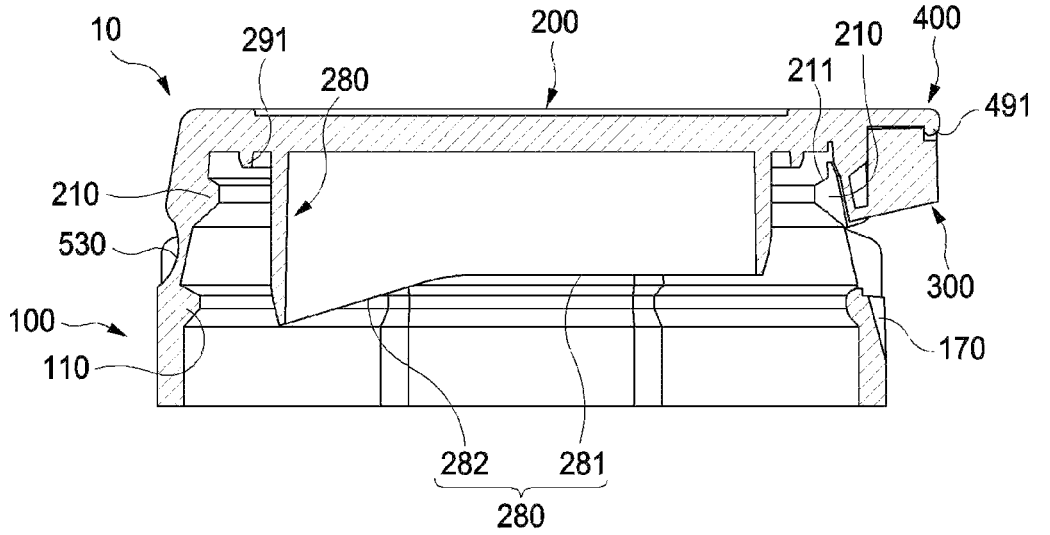
FIG. 12*b* is a cross-sectional view in a direction B1-B1 in FIG. 11*b*.
Figure 13A:
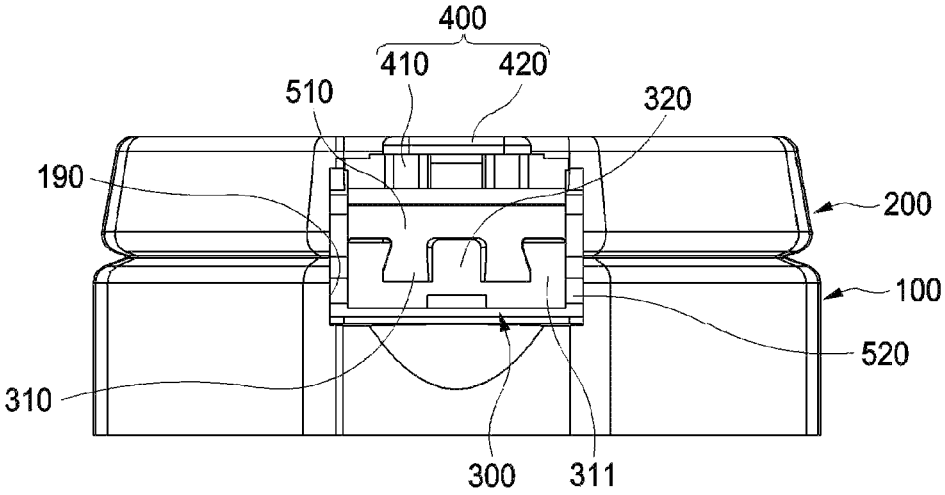
FIG. 13*a* is a front view illustrating the state in FIG. 11*a*.
Figure 13B:
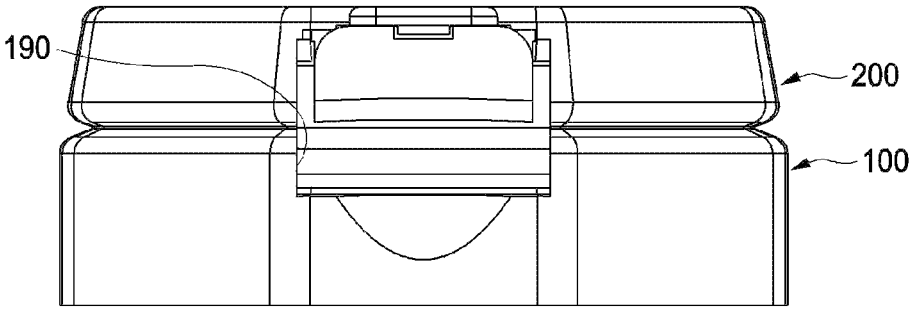
FIG. 13*b* is a front view illustrating the state in FIG. 11*b*.
Figure 14:
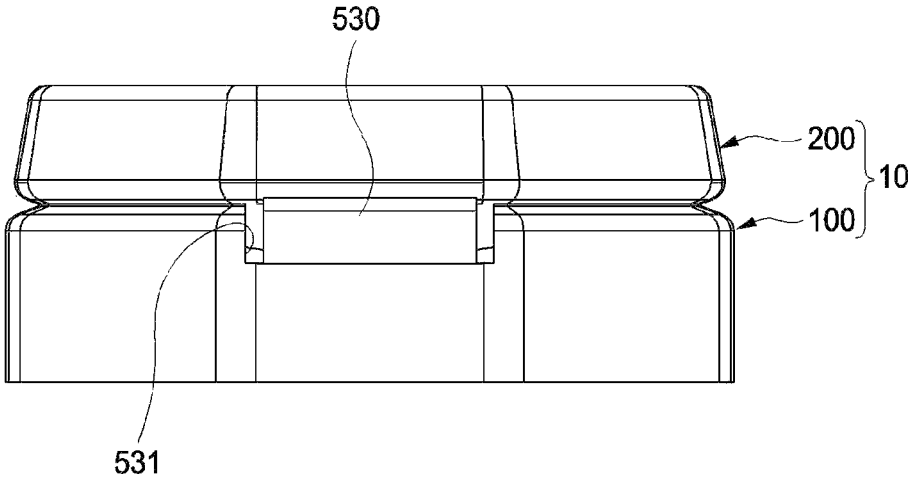
FIG. 14 is a rear view illustrating the state in FIG. 11*a*.
Figure 15:
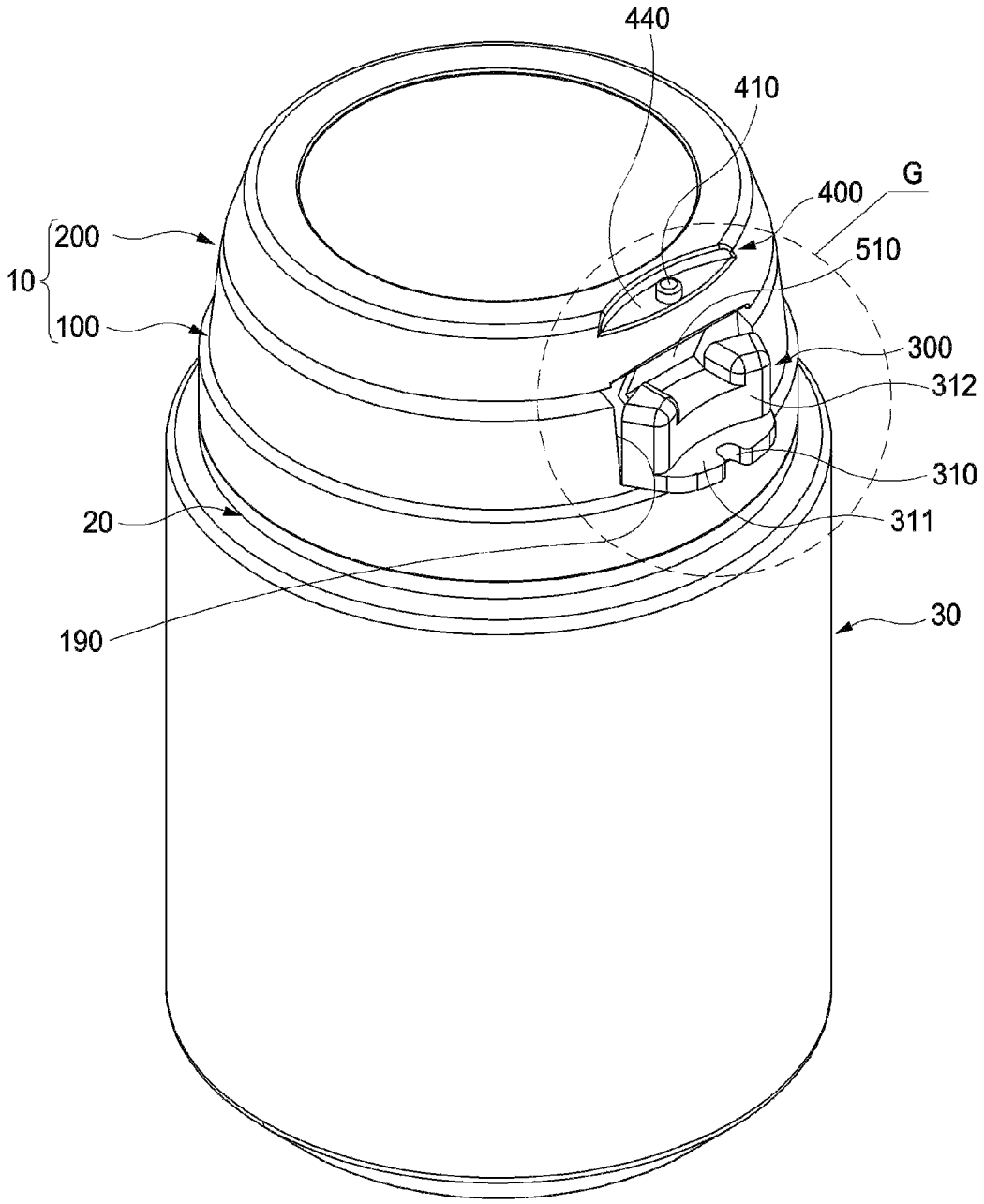
FIG. 15 is a perspective view illustrating a container cap according to the third embodiment of the present invention.

The separation part 300 may be pressed upward toward a bottom surface of the lower end 311 by the user's manipulation to rupture the second connection part 520, and thus, the lower end 311 of the separation part 300 may relatively further protrude with respect to the outer circumferential surface of the main body part 100, or as illustrated in FIGS. 11*a* and 11*b*, the separation part 300 may be provided with a finger entry convex part 170 defined to be convex below the separation part in the state in which the separation part 300 is coupled to the main body part 100.

The finger entry convex part 170 may be a configuration that is provided to be convex below the separation part 300 in the state in which the separation part 300 is coupled to the main body part 100 so that the finger easily enters, and may have various shapes.

The fixing part 300 may be a configuration that is disposed on the cover part 200 so that the separation part 300 is fixed and coupled after the second connection part 520 is separated by the user's manipulation so that the cover part 200 is separated from the main body part 100, and any configuration may be possible as long as the fixing part 300 is coupled to the connection part 300.

For example, as described above, the fixing part 400 may be provided with a protrusion 410 inserted into the concave part 310 to correspond to the formation of the concave part 310 when the connection part 300 is disposed on the concave part 310.

The fixing part 400 may include a covering part 490 having a projected area that includes the entire upper side of the protrusion 410 when viewed from the above.

The covering part 490 may be provided with a hook part 491 protruding downward from the center of the container cap at the end, and the separation part 300 may be provided with a fitting groove 391 in which the hook part 491 is fitted in the state of being separated from the main body part 100 and folded upward.

In addition, the covering part 490 may be provided to be larger than each of upper and lower projected areas of the separation part 300 when viewed from the above, but as illustrated in FIGS. 11*a* to 14, the separation part 300 may be provided to be less than each of the upper and lower projected areas of the separation part 300 when viewed from the upper side.

In addition to the coupling of the concave part 310 and the protrusion 410 as described above, the separation part 300 and the fixing part 400 may be firmly coupled to each other by combination of the hook part 491 and the fitting groove 391.

In the state illustrated in FIGS. 2 and 4*a*, when the separation part 300 are separated from the main body part 100 by the user's manipulation and then coupled to the fixing part 400, the state in FIGS. 3A and 4*b* may be realized, and the user may press the separation part 300 and the fixing part 400, which are coupled to each other, upward to separate the cover part 200 from the container inlet 20.

In addition, the user may discharge the contents of the container 30 to the outside and then rotate the cover part 200 again to be coupled to the container inlet 20.

Here, as described above, the inside of the container 30 may be maintained in the sealed state by the sealing and coupling between the cover part 200 and the container inlet 20.

The container cap 10 according to the present invention described with reference to FIGS. 2 to 8 has been described as an example of the circular shape when viewed from the above, but as illustrated in FIGS. 11*a* to 14, the container cap 10 may have a polygonal shape such as an octagonal shape, etc.

The container cap 10 according to the second embodiment of the present invention may be almost the same as or similar to the container cap according to the first embodiment of the present invention except that the container cap 10 has an octagonal shape (various polygonal structures such as squares (squares, rectangles, etc.), hexagons, etc.) when viewed from the above, and thus, their detailed descriptions will be omitted. Here, the inner circumferential shape of the container inlet 20 may be octagonal (various polygonal structures such as squares and hexagons) in addition to the circular shape.

Here, when each of the container cap 10 and the container inlet 20 has the polygonal structure, each of the container cap 10 and the container inlet 20 may have a curvature near a vertex.

The separation part 300 and the fixing part 400 described above may be implemented in various embodiments.

Hereinafter, the container cap according to the third embodiment of the present invention will be described with reference to FIGS. 15 to 17*c*.

Specifically, in the container cap according to the third embodiment of the present invention, only structures of the separation part 300 and the fixing part 400 have been changed, and thus, only the changed portions will be described.

First, the separation part 300 may be provided with a concave part 310 defined at a lower portion 311 and may have an 'L' shape when viewed from a lateral side.

In addition, the fixing part 400 may be provided with a protrusion 410 inserted into the concave part 310 of the separation part 300 by separating and tilting the separation part 300 from the main body part 100.

In particular, the fixing part 400 may be provided with a seating surface 440, on which a lower end 311 of the separation part 300 is surface contact with the seating surface 440, and a protrusion 410 may be provided as a protruding rod protruding upward.

That is, the fixing part 400 may be disposed on the cover part 200 as a fitting part into which the separation part 300 is fitted in a 'U' shape when the separation part 300 is tilted upward.

Here, in the separation part 300, an upper portion of the lower end 311 may be provided as a curved surface 312 corresponding to a shape of an outer circumferential surface at a side of the fixing part 400.

The seating surface 440 may be provided as a surface that is gentle with a top surface of the cover part 200 in the state in which the separation part 300 is coupled, or may be provided as a concave groove so as to protrude relatively less.

Like the fifth embodiment (see FIGS. 21 to 23*b*), the third embodiment illustrated in FIGS. 15 to 17*c* may have various embodiments according to the formation positions of the protrusion 410 and the concave part 310.

That is, as illustrated in FIGS. 21 to 23*b*, the protrusion 410 may protrude from the outer circumferential surface of the cover part 200, and in this case, the concave part 310 may be defined at the formation position of the protrusion 410 and also defined according to the cross-sectional shape.

For example, the protrusion 410 may be provided in a '-' or 'l' shape when viewed from a side surface of the cover part 200, and the concave part 310 may be provided as a slit having a '-' or 'l' shape correspondingly.

In addition, an auxiliary protrusion 441 may be additionally provided at a lower side of the protrusion 410 to support a first connection part 510, which is a thin portion, when the separation part 300 is tilted upward.

Hereinafter, the container cap according to the fourth embodiment of the present invention will be described with reference to FIGS. 18 to 19*c*.

The container cap according to the fourth embodiment of the present invention may be a modified example of the first to third embodiments of the present invention may further include a sealing member 400 of which a bottom surface is attached to an upper end of the container inlet 12 of the container 10 and which is coupled to the container cap 10, in particular, the cover part 200.

The sealing member 40 may be a configuration of which a bottom surface is attached to an upper end of the container inlet 20 of the container 30 and is coupled to the container cap 10, in particular, to the cover part 200 to seal the container 30 and may have various configurations according a coupling structure of to the container cap 10, in particular, the cover part 200.

In particular, the sealing member 40 may have coupling force between the sealing member 40 and the container cap 10, which is greater than that between the container inlet 20 and the sealing member 40, so that the cover part 200 is separated from the container inlet 20 when being separated from the container inlet 20.

Figure 16A:
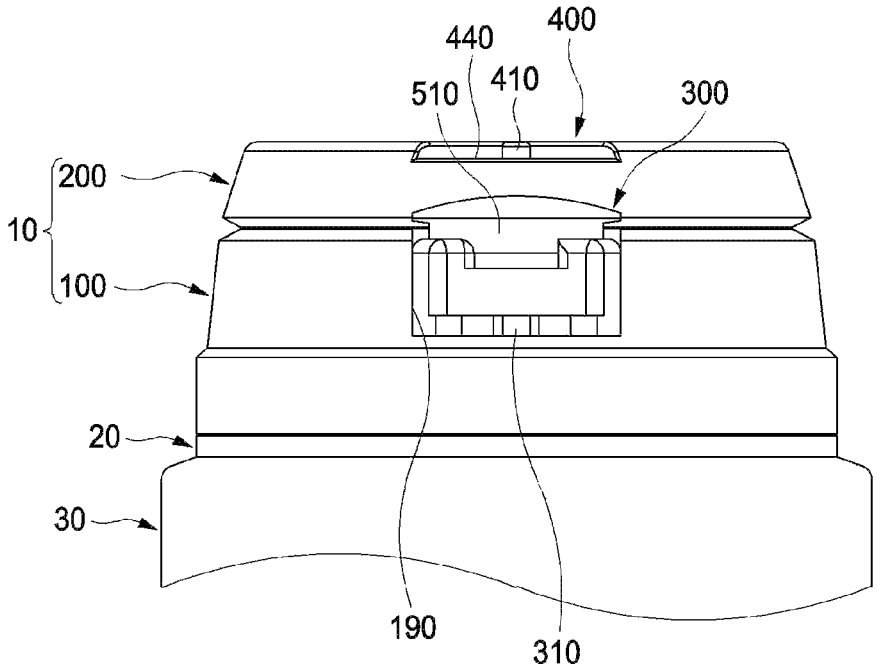
FIGS. 16*a* and 16*b* are perspective views illustrating the container cap of FIG. 15.
Figure 16B:
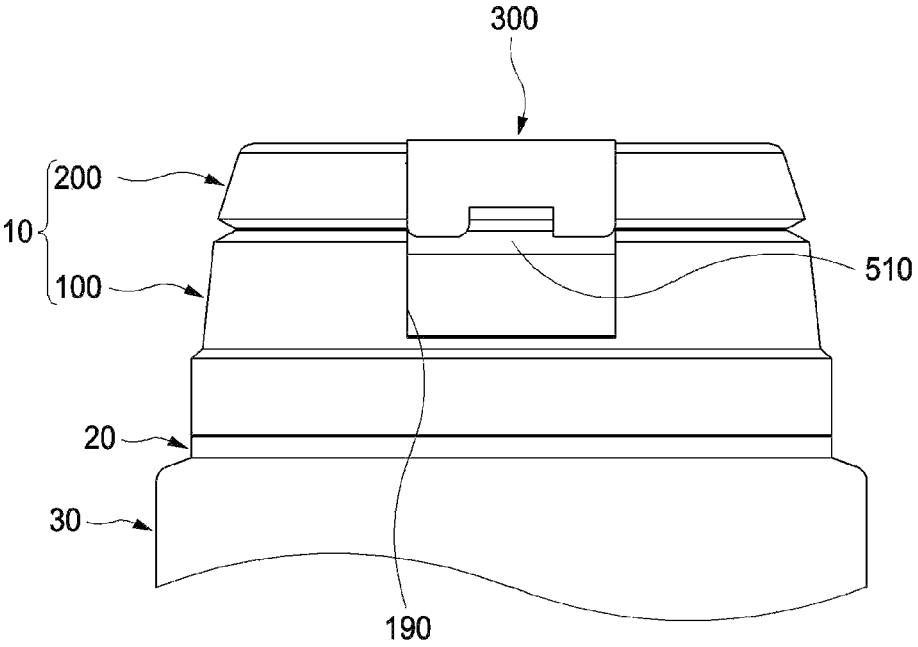
Figure 17A:
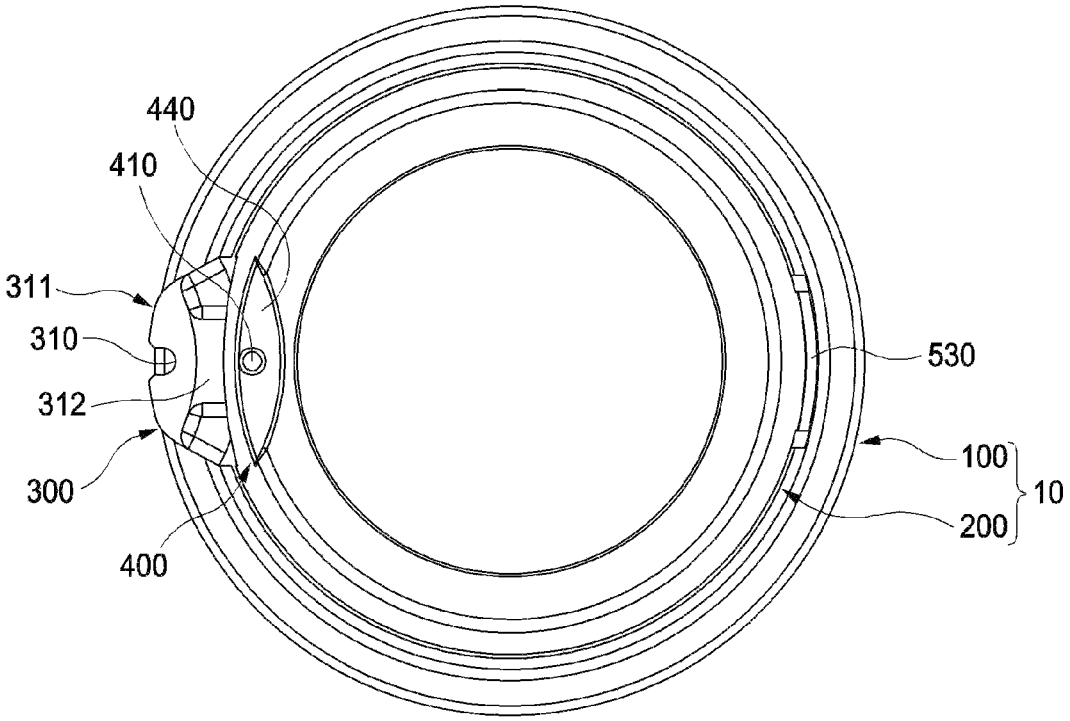
FIGS. 17*a* and 17*b* are plan views illustrating a container cap of FIG. 15.
Figure 17B:
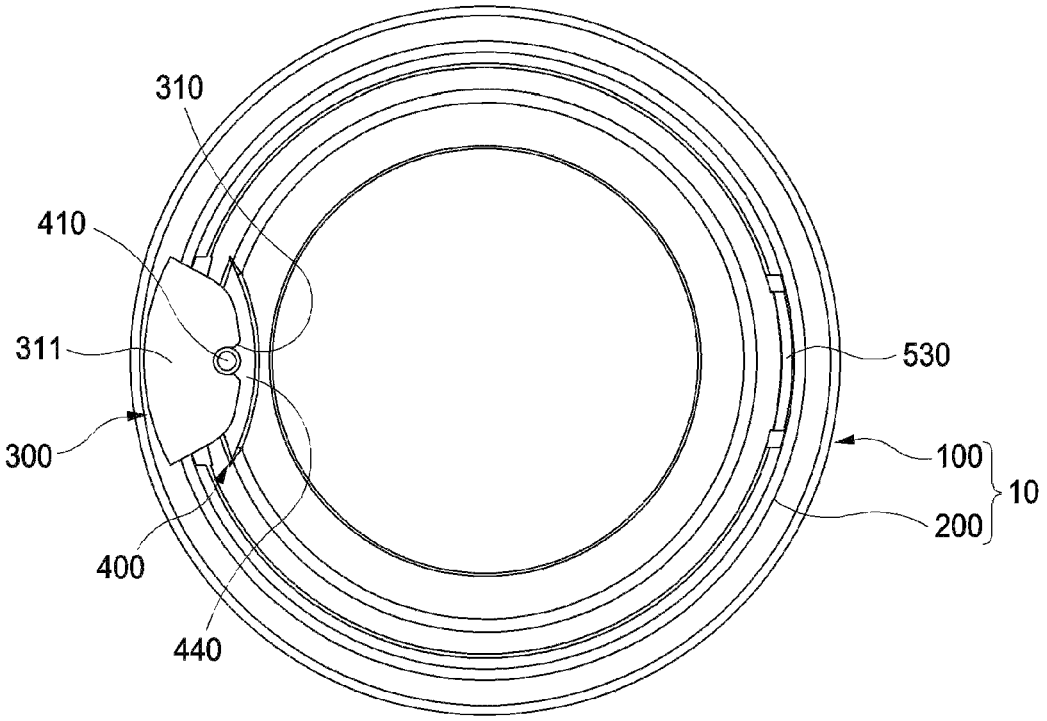
Figure 17C:
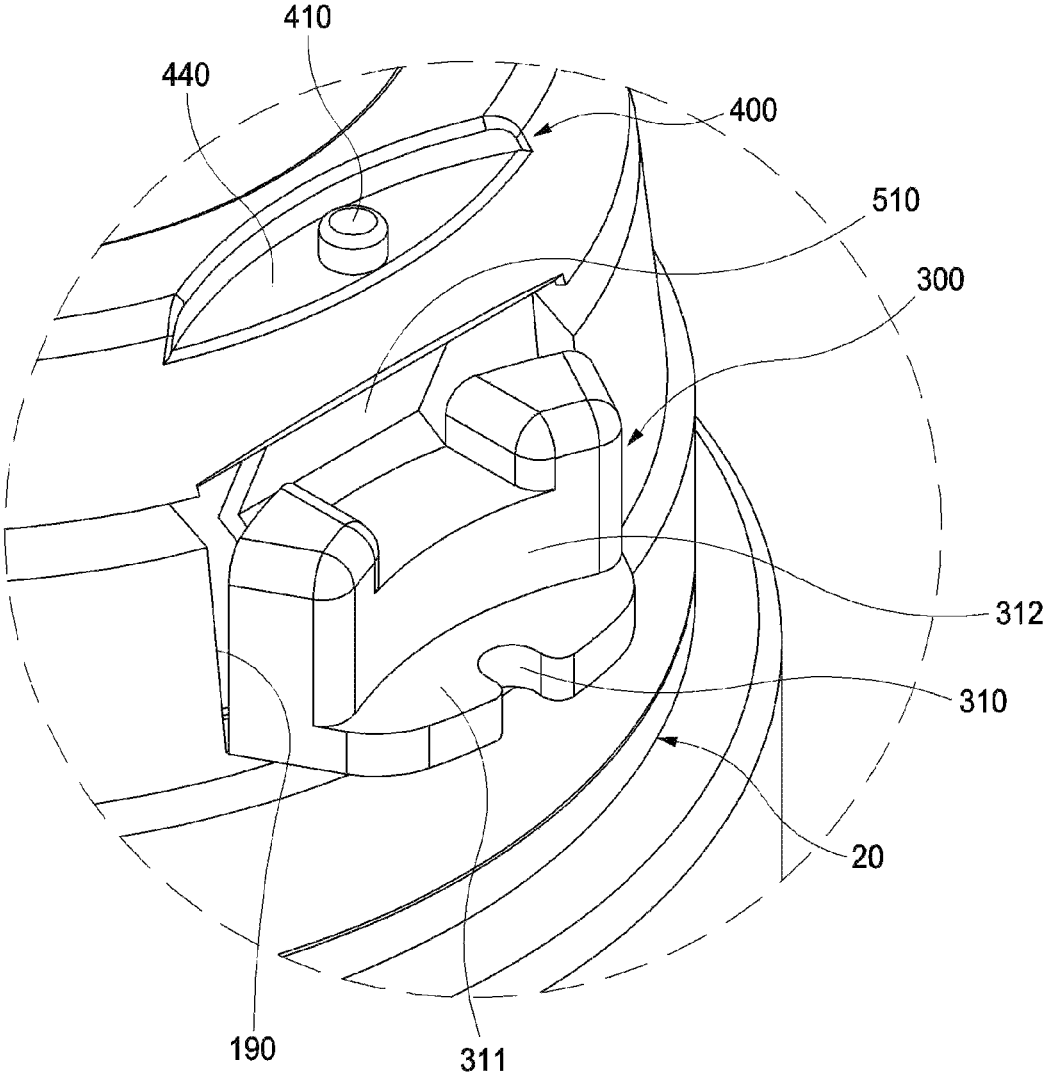
FIG. 17*c* is an enlarged perspective view of a portion G in FIG. 15.

For example, as illustrated in FIG. 16, the sealing member 40 may include a metal sheet layer 611 and a first resin layer 613 and a second resin layer 615, which are coupled to top and bottom surfaces of the metal sheet layer 611, respectively.

Here, the top surface 21*a* of the container inlet 20 may be preferably provided to be flat for the attachment of the sealing member 40.

The metal sheet layer 611 may be a metal layer that is attached to the top surface 21*a* of the container inlet 20 by rigidity of the sealing member 40 and an induction or conduction method and may be made of commercially available metal materials used for the sealing member other than aluminum and an aluminum alloy.

The metal sheet layer 611 may have a thickness of 6 μm to 200 μm.

Each of the first resin layer 613 and the second resin layer 615 may be a resin layer coupled to the top and bottom surfaces of the metal sheet layer 611 and may be especially made of PET.

Each of the first resin layer 613 and the second resin layer 615 may have a thickness of 10 μm to 150 μm.

Here, the first resin layer 613 and the second resin layer 615 may respectively adhere to the top and bottom surfaces of the metal sheet layer 611 by an adhesive layer (not shown) on a surface of the aluminum sheet material.

Here, the adhesive layer may be a material for adhering the resin layer such as PET to the surface of the aluminum sheet material, and a commercial adhesive for the sealing member described later may be used.

The sealing member 40 having the above structure may seal the container 30 with sufficient adhesive force due to the coupling force when the container cap 10 is coupled to the container inlet 20, and the container cap 10 may be easily separated when the container cap 10 is separated from the container inlet 20, and thus, the sealing and separation of the container 30 may be easy.

For reference, the sealing member 40 may be in a state in which an end of an edge portion 41 is fitted into the container cap 10, and thus, when the container cap 10 is separated, the sealing member 40 may be separated from the container inlet 20 in the state of being fixed to the container cap 10.

In particular, a portion of the edge portion 41 of a bottom surface of the sealing member 40 may also be attached to a top surface of a support 733, and thus, coupling force of the sealing member 40 with respect to the container cap 10 may be greater than that of the sealing member 40 with respect to the top surface 22*a* of the container inlet 20.

In addition to the embodiment described above, the sealing member 40 may be implemented in various embodiments according to materials of the container 30 and the container cap 10 for the adhesion with the top surface 12*a* of the container inlet and the adhesion with the container cap 10.

In particular, the sealing member 40 may have a functional layer that provides an easy-peel function on at least one surface of the top and bottom surfaces.

For example, the sealing member 40 may have a structure to be applied to a container assembly according to the present invention, and a CPP layer 617 may be disposed on a bottom surface of the second resin layer 615.

The CPP layer 616 may be a layer having heat-sealing properties to provide the easy-peel function together with the adhesive layer 617 and be made of casting poly propylene.

The CPP layer 616 may have a thickness of 10 μm to 30 μm.

The sealing member 40 may be provided with an adhesive layer 617 on a bottom surface of the CPP layer 616 for adhesion with the top surface 22*a* of the container inlet 20 to improve adhesion performance to the container inlet 20.

The adhesive layer 617 may be a layer for adhesion with the top surface 22*a* of the container inlet 20 and may be made of a material having the easy peel property, which is commonly used for adhesion between resins.

The adhesive layer 617 may have a thickness of 10 μm to 500 μm.

The sealing member 40 according to the present invention has to have lower coupling force to the container inlet 20 than the coupling force to the container cap 20, and thus, the adhesive performance with the easy-peel function may be desirable.

For this, the sealing member 40 according to the present invention may be an easy-peel layer for providing the easy-peel function and may be disposed on a surface on which the easy-peel layer made of acryl, urethane, polyethylene (LDPE, LLDPE, MDPE, HDPE), metallocene polyethylene, polypropylene, styrene-butadiene-rubber (SBR), EVA, EAA, EEA, EMAA, EMA, IONOMER, surlyn, polyester, co-polymer, easy peel resin, etc. is in contact with the top surface 22*a* of the container inlet 20.

As another example, the sealing member 40 may be provided as seven layers such as an easy-peel coating layer 322 (1 μm to 100 μm), 2) a PET layer 313 (12 μm to 350 μm), which is a polyester film, 3), a polyurethane adhesive layer 312 (1 μm to 12 μm), 4) a hard aluminum foil layer 611 (1 μm to 100 μm), 5) a polyurethane adhesive layer 312 (1 μm to 12 μm), 6) a PET layer 315 (12 μm to 350 μm), which is a polyester film, and an easy-peel coating layer 321 (1 μm to 100 μm).

Figure 20:
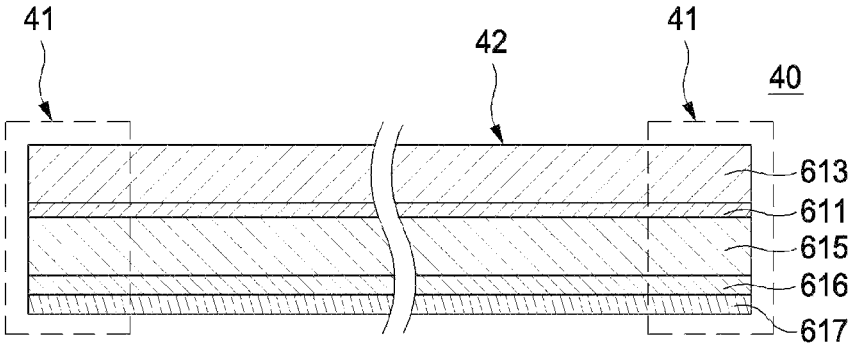
FIG. 20 is a partial cross-sectional view illustrating an example of the sealing member installed on the container cap of FIG. 18.

The sealing member 40 may use containers and sealing members made of various materials disclosed in WO2022/065883 in addition to the embodiment of FIG. 20.

Easy-Peel Functional Layer

There are two methods for forming a layer having the easy-peel function such as liquid coating and melt extrusion coating.

The liquid coating method may be performed using a water-based or oil-based liquid material by combining resins such as m-PE, LDPE, HDPE, LLDPE, PP, EVA, Olefin, EAA, EMA, EMAA EEA, and rubber and may be a coating method using a gravure printing M/C (machine), micro gravure M/C, and dry lamination M/C on surfaces of a film and a sheet.

The melt extrusion coating method uses an extrusion laminate M/C to extrude the film and sheet to a certain thickness. The melt extrusion coating method may be an extrusion method in which a resin chip made by combining the resins such as m-PE, LDPE, HDPE, LLDPE, PP, EVA, Olefin, EAA, EMA, EMAA, EEA, rubber, etc. is melted at a high temperature in a range of 150° C. to 350° C. using an extruder to control a thickness through a T-die.

Adhesive Layer

The adhesive layer may use two-component polyurethane with excellent heat resistance, cold resistance, and water resistance, and may adhere in a manner in which the film or sheet is combined using the dry lamination M/C and then cured. The adhesive may consist of a base material (polyester, polyether), a hardener (isocyanate), and a solvent (MEK, EA).

PET Film Layer

The PET film layer may be a biaxially stretched polyester film with excellent heat and cold resistance, and be treated with corona discharge at both sides to maintain surface tension in a range of 36 dyne/cm to 60 dyne/cm.

Aluminum Foil Layer (Metal Sheet Layer)

Hard aluminum and soft aluminum may be used, and foil with surface tension of 60 dyne/cm or more at both sides may be used. A material may use a material of A1000 series such as A1235, A1100, etc. with aluminum purity of 99% or higher.

Easy-Peel Co-EX Film Layer

The easy-peel co-EX film layer may be a multi-layer co-extruded film with the easy-peel function added to the heat adhesive layer. A multi-layer film may be produced by combining the resins such as m-PE, LDPE, HDPE, LLDPE, PP, EVA, Olefin, EAA, EMA, EMAA, EEA, and rubber. The film may be produced in a variety of manners in a range of a single-layer film to a 12-layered film depending on the type of extruder.

Co-EX Film Layer

The co-EX film layer may be a multi-layer co-extruded film that is most commonly used for general heat sealing purposes. A multi-layer film may be produced by combining the resins such as m-PE, LDPE, HDPE, LLDPE, PP, EVA, Olefin, EAA, EMA, EMAA, EEA, and rubber. It does not have the easy-peel function and is mainly used for heat sealing. The film may be produced in a variety of manners in a range of a single-layer film to a 12-layered film depending on the type of extruder.

The top surface of the sealing member 40 as described above may adhere to a bottom surface of a coupling part 230 of the container cap 20 using heat generated in the metal sheet layer by application of high frequency (i.e., induction method), and the bottom surface of the sealing member 40 may adhere to the top surface 22*a* of the container inlet 20.

Here, physical properties of the top and bottom surfaces of the sealing member 40 may be configured differently, and the sealing member 40 may be provided with a mark, for example, a color, a symbol, or a letter, to distinguish the bottom and to surfaces from each other.

Due to the above configuration, the sealing member 40 may have relatively greater coupling force to the cover part 200, and thus, when the cover part 200 is separated from the container inlet 20, the sealing member 40 may be separated from the container inlet 20.

In addition, in order to separate the sealing member 40 from the container inlet 20, the user may rotate the container cap 10 with respect to the container inlet 20 and then separate the cover part 200 from the container inlet 20.

Figure 19A:
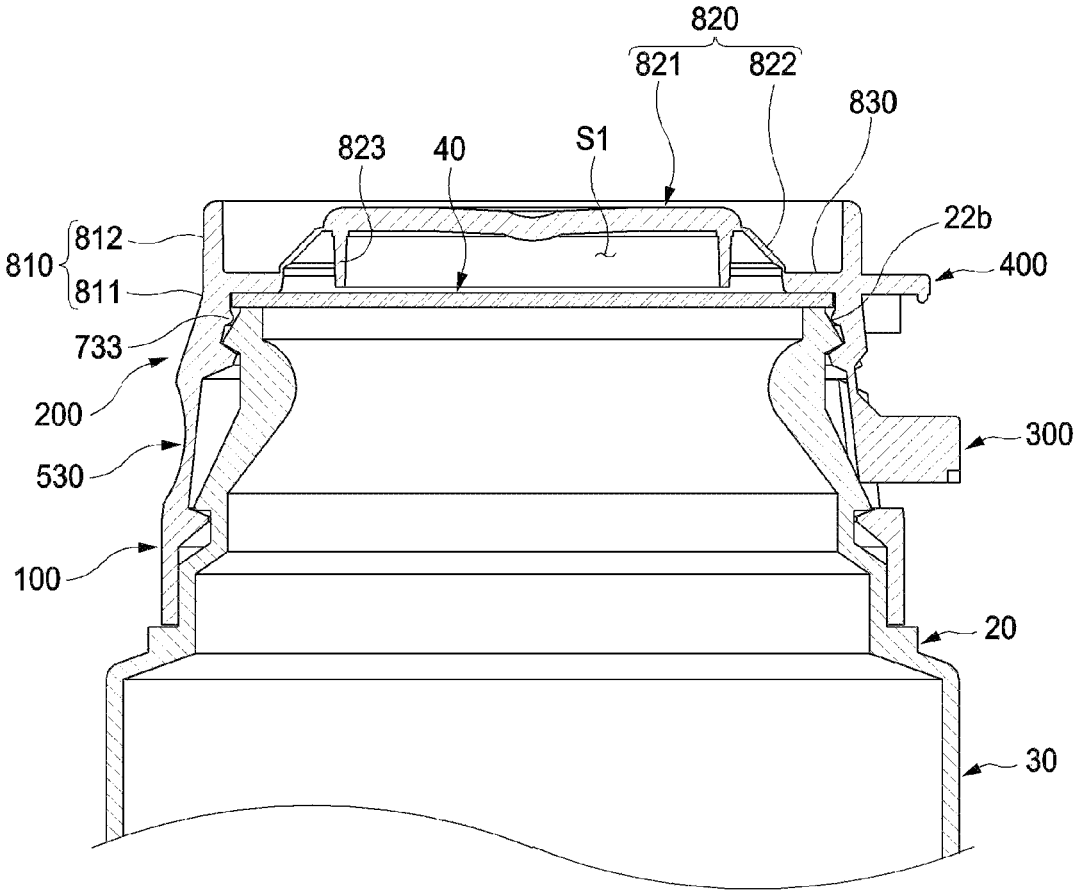
FIGS. 19*a* to 19*e* are cross-sectional views illustrating a container cap of FIG. 18.
Figure 19B:
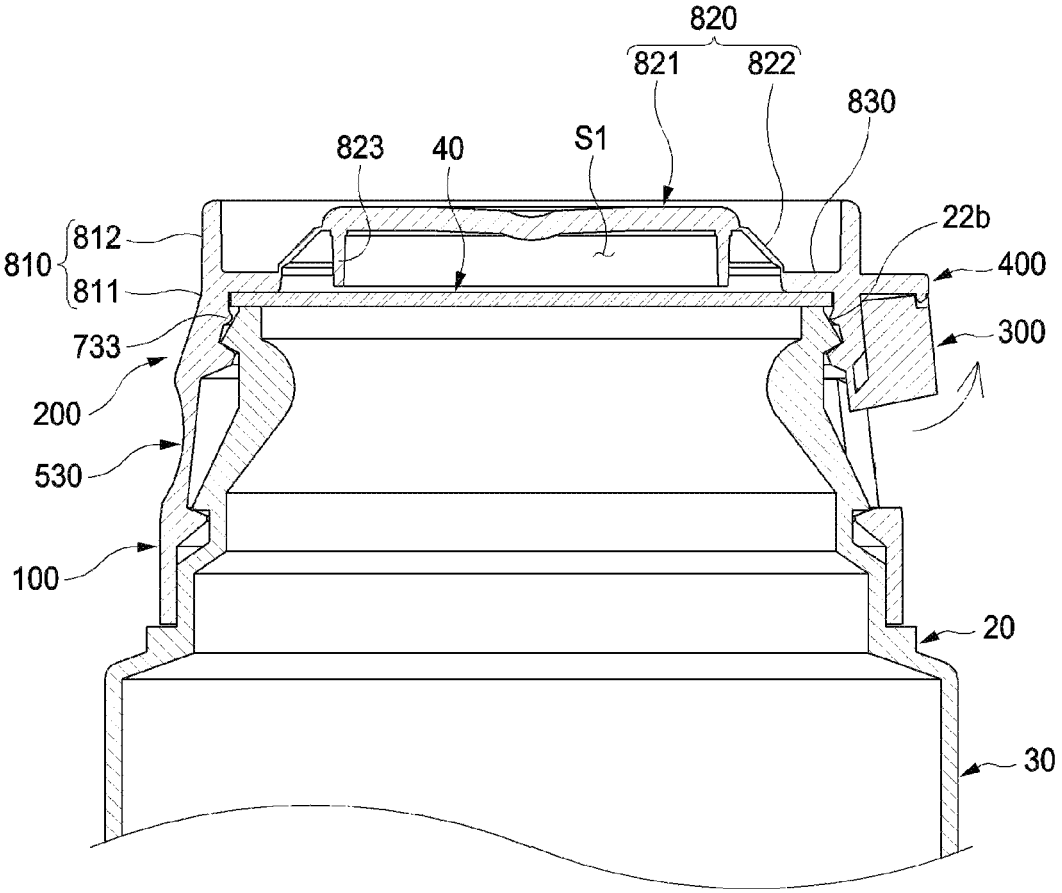
Figure 19C:
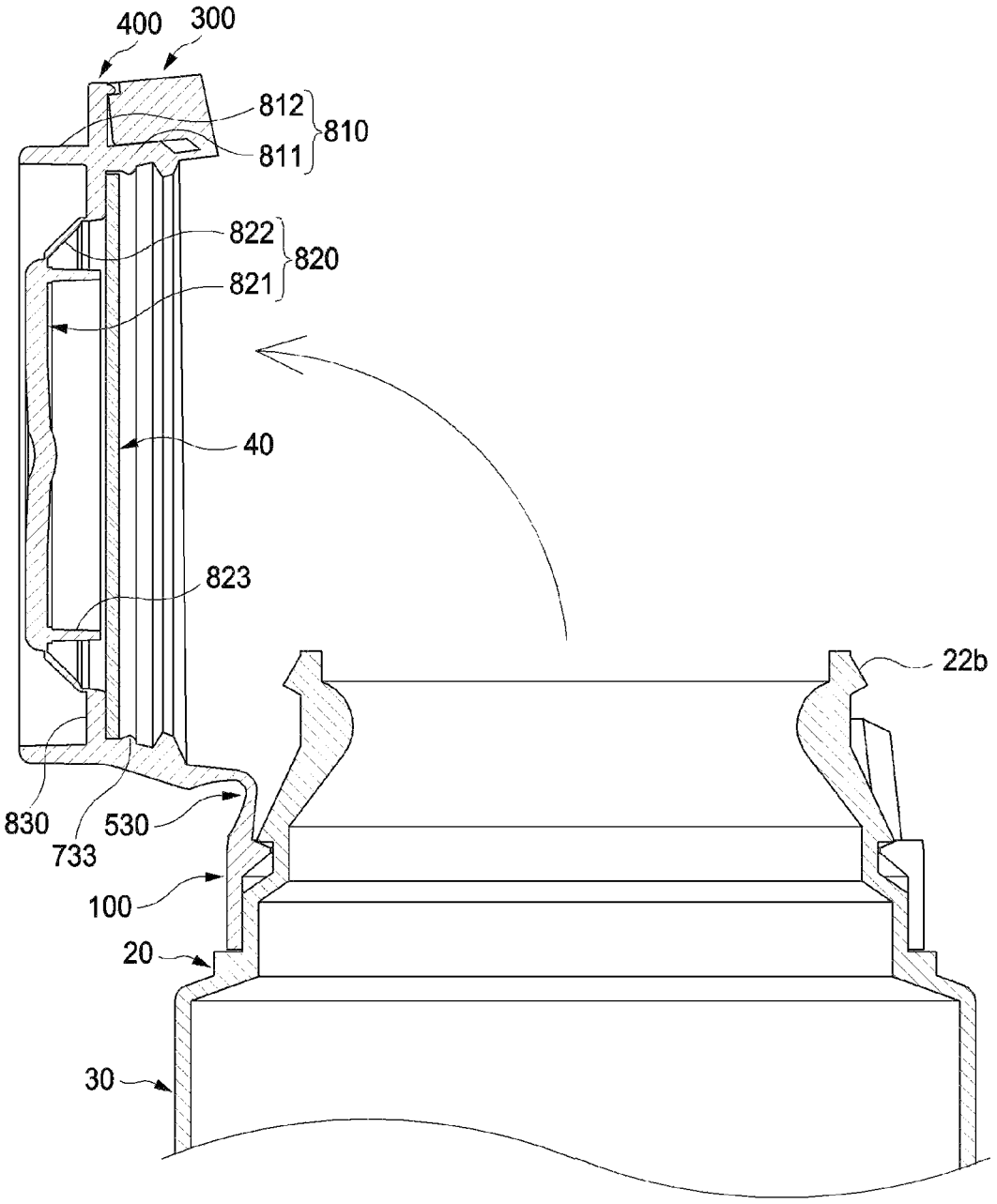

In addition, the sealing member 40 having the above configuration may be removed from the container cap 20 after the container cap 20 is separated from the container inlet 20 as illustrated in FIG. 19*c*, or may be used in a state of being stored in the container cap 20.

In particular, when used in the state of being stored in the container cap 20, the sealing member 40 may maintain a sealing effect of the container 60 to some extent by securing a certain degree of the adhesion to the container inlet 20.

For this, rigidity of the sealing member 40 may be strengthened by increasing in thickness of the edge portion 61, especially a thickness of the metal sheet layer 611, or be strengthened to be formed to have higher hardness.

In addition, the sealing member 40 may be provided with a rib, etc. at a level that does not impair the adhesion and sealing of the top surface 22*a* of the container inlet 20 and the bottom surface of the coupling part 230 of the container cap 20 to reinforce the rigidity.

The cover part 200 includes a cover main body 810 coupled to the container inlet 20 and a sealing member separation part 820 installed on the cover main body 810 to separate the sealing member 40 from the cover main body 810.

The cover part 810 may be integrated with the main body part 100, be hinge-coupled to the main body part 100, and be coupled to the container inlet 20 and also may have various structures.

The cover main body 810 may have a cylindrical shape corresponding to a planar shape of the container inlet 20.

In addition, the cover main body 810 may be coupled to the container inlet 20 by fitting.

In addition, the cover main body 810 may include a partition part 812 disposed at a position that is equal to or higher than that a top surface of a pressing part 821, which will be described later, at an upper side with respect to the coupling part 830, which will be described later, and a container coupling part 811 coupled to the container inlet 20.

The partition part 812 may be a portion disposed at a position that is equal to or higher than that of the top surface of the pressing part 821, which will be described later, so that the pressing part 821, which will be described later, is not arbitrarily pressed, and also, various configurations are possible.

The container coupling part 811 may be a portion coupled to the container inlet 20 and may have various configurations depending on the coupling structure of the container inlet 20, and also, the container coupling part 811 may be provided as a configuration that seals the inside of the container 30 before and after the sealing member 40 is removed.

In addition, the container coupling part 811 may be integrated with the main body part 100 and be capable of hinge rotation by the hinge part 530, and thus, the container coupling part 811 may have various structures as described above depending on the coupling structure of the container inlet 20.

When the cover part 200 is separated from the container inlet 20, the sealing member 40 attached to the top end of the container inlet 20 has also to be separated, and thus, the sealing member 40 may need to be coupled to the cover part 200.

Here, various embodiments are possible depending on the coupling structure between the sealing member 40 and the cover part 200.

In an embodiment of the present invention, the top surface of the sealing member 40 may be attached to the cover main body 810, and for this, the cover main body 810 may include a coupling part 830 to which a top surface of an edge 41 of the sealing member 40 is attached to correspond to the portion that is coupled to the top surface 22*a* of the container inlet 20.

The coupling part 830 may be a configuration to which the top surface of the edge 41 of the sealing member 40 is attached to correspond to the portion coupled to the top surface 22*a* of the container inlet 20, and also, various configurations are possible.

That is, the coupling part 830 may be provided to protrude further inward from the inner circumferential surface of the cover main body 810 so as to be in close contact with the top surface of the sealing member 40 and may be integrated with the cover part 810.

For example, as illustrated in FIGS. 19*a* to 19*c*, the coupling part 830 may have a flat surface so as to be in close contact with the top surface of the sealing member 40.

The container cap according to the fourth embodiment of the present invention having the above configuration operates as follows.

First, before first opening, the sealing member 40 and the container cap 20 that seal the container inlet 20 may be in a state of being coupled to the container inlet 20.

When the user separates the container cap 20 by rotating or snapping, the container cap 20 and the sealing member 40 may be separated together from the container inlet 20 at a relative magnitude of the coupling force of the sealing member 40 to the container cap 20.

The user may seal the container 30 by reattaching the container cap 20 to the container inlet 20 after discharging the contents of the container 30 to the outside, such as for drinking.

Here, the sealing member 40 may secure a certain degree of the sealing force by the easy-peel function of the surface that is in contact with the container inlet 20.

When the user presses the pressing part 821 according to his/her choice, the sealing member 40 may be separated from the container cap 20 and then be removed.

The cover main body 810 may be provided with a support 733 protruding inward at a distance from the bottom surface of the coupling part 830 that is in contact with the top surface of the sealing member 40 so that the sealing member 20 separated from the container inlet 20 is maintained in the state of being coupled to the container cap 20.

The support 733 may be a configuration that protrudes inward from an inner circumferential surface of the cover main body 810 at a distance from the bottom surface of the coupling part 830 that is in contact with the top surface of the sealing member 40 so that the sealing member 20 separated from the container inlet 20 is maintained in the state of being coupled to the container cap 20, and also, various configurations are possible.

The support 733 may have any shape as long as a portion of the edge of the sealing member 40 is inserted, and a gap between the support 733 and the bottom surface of the coupling part 830, which is in contact with the top surface of the sealing member 40, may be substantially the same or greater or less than a thickness of the sealing member 40.

The support 733 may be in contact t with an outer circumferential inclined surface 22*b* of the container inlet 20 and be used to seal the container inlet 20 when the cover part 200 is coupled to the container inlet 20.

In particular, the support 733 may be in contact with the outer circumferential inclined surface 22*b* of the container inlet 20 even when the sealing member 40 is removed, and thus, when the cover part 200 is coupled to the container inlet 20, the support 733 may seal the container inlet 20 when the cover part 200 is coupled to the container inlet 20.

The sealing member separator 820 may be a configuration that is installed on the cover main body 810 to separate the sealing member 40 from the cover main body 810, and various configurations are possible.

Figure 18:
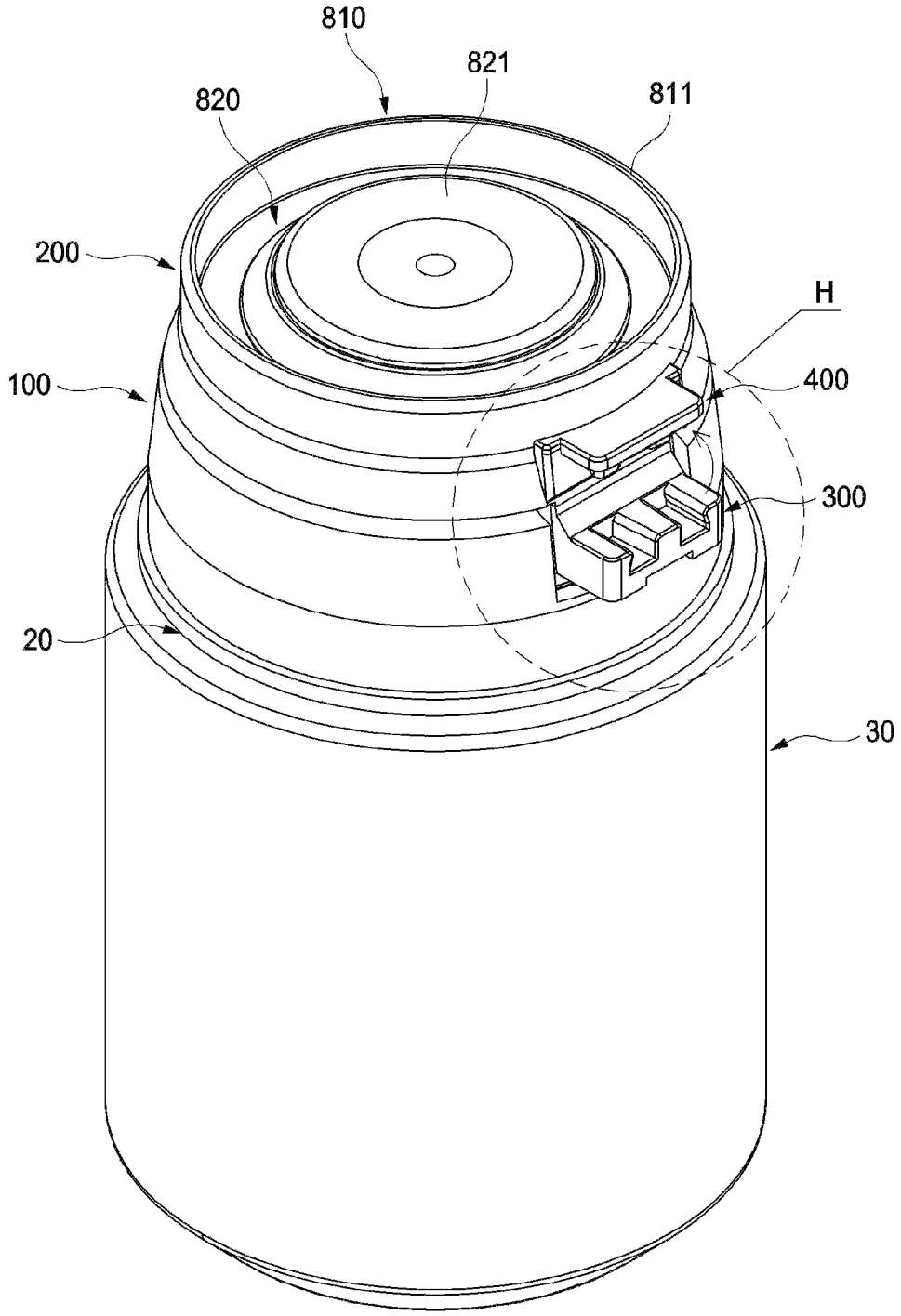
FIG. 18 is a perspective view illustrating a container cap according to the fourth embodiment of the present invention.
Figure 19D:
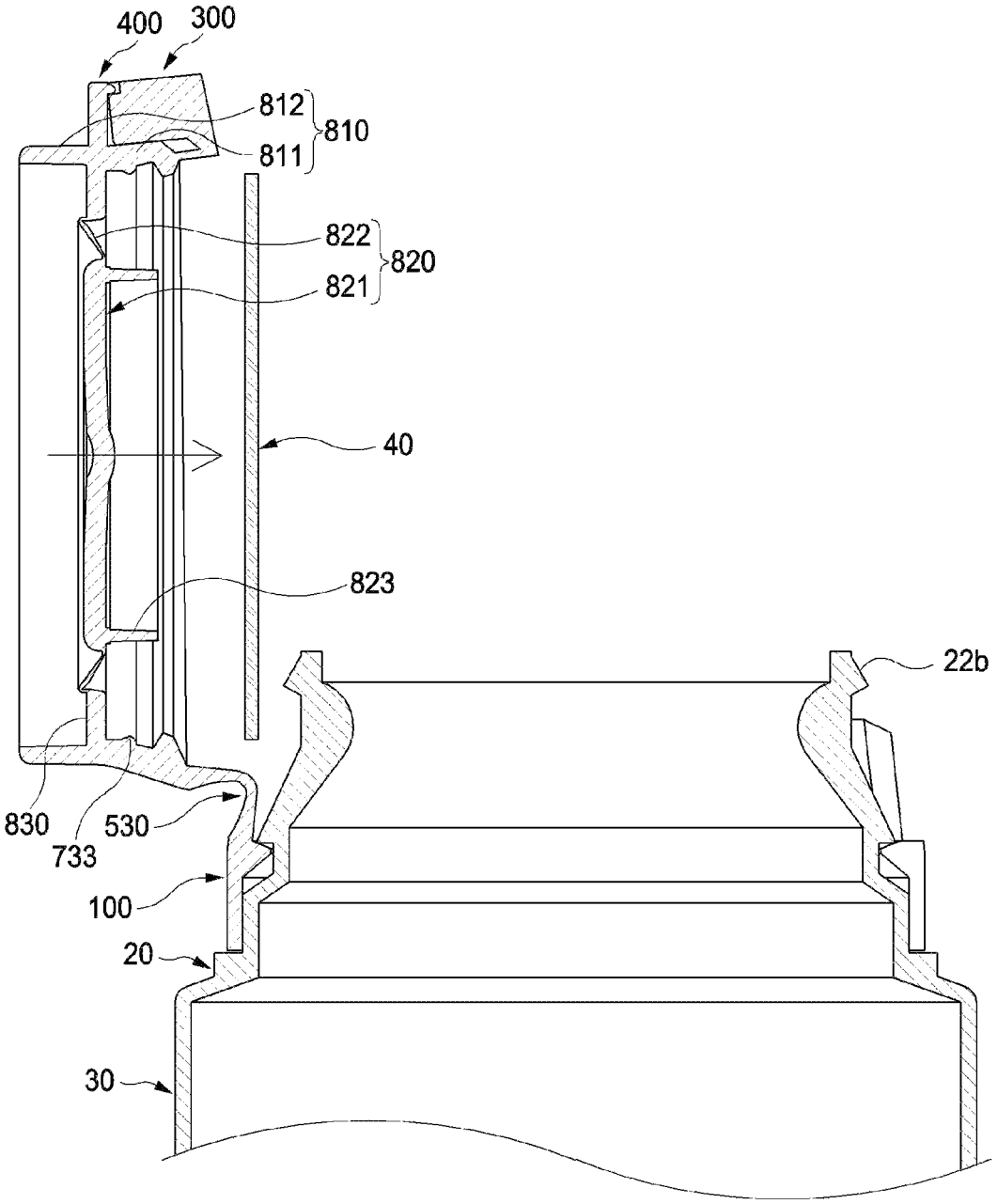
Figure 19E:
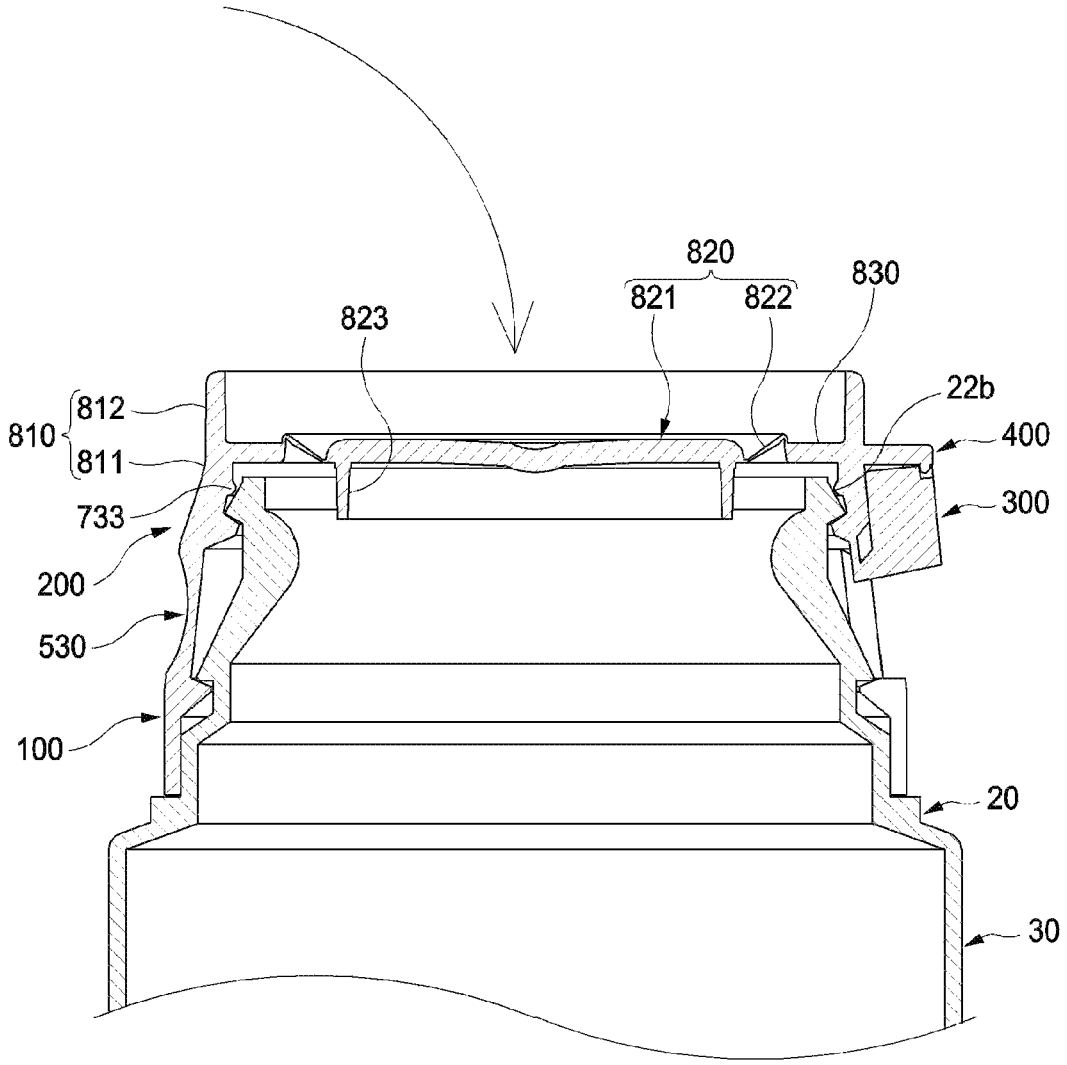
Figure 19F:
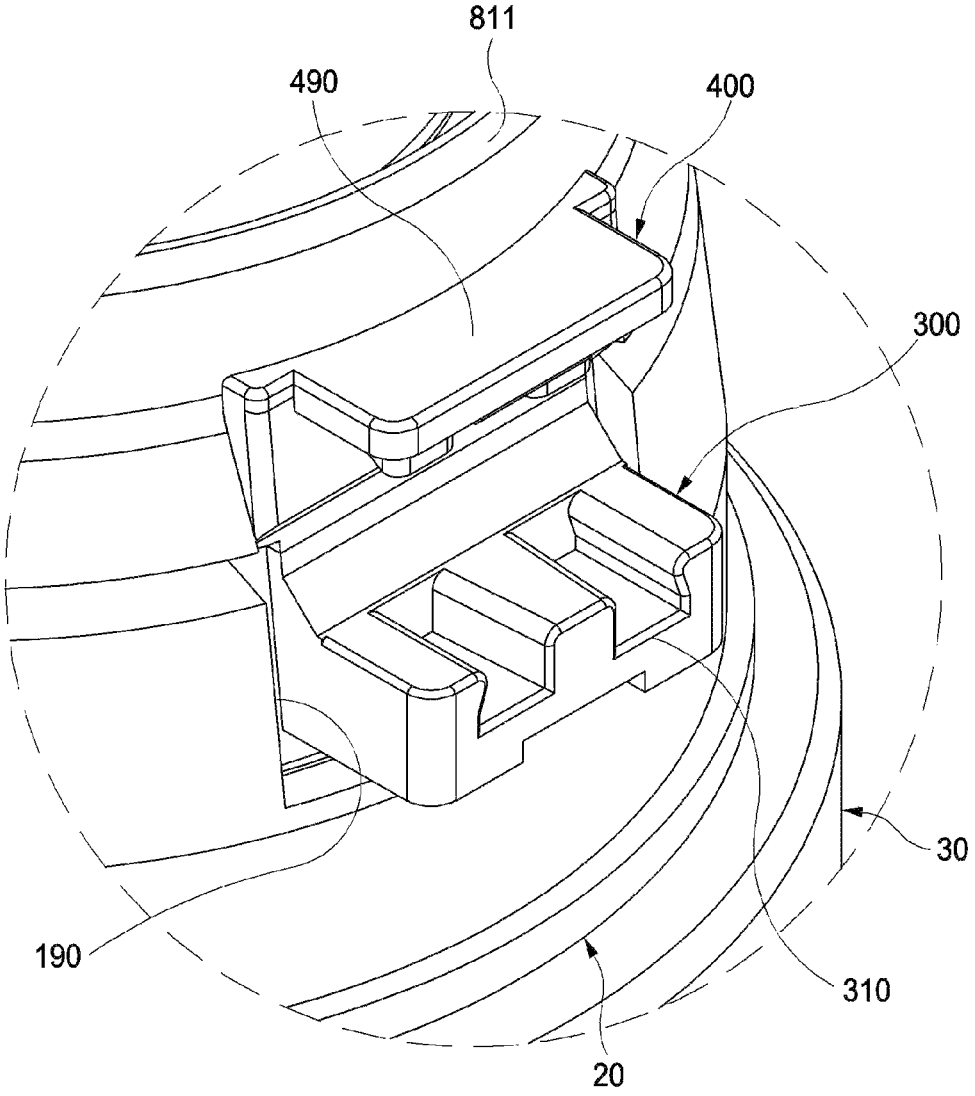
FIG. 19*f* is an enlarged perspective view of a portion H in FIG. 18.

For example, as illustrated in FIGS. 18 to 19*d*, the sealing member separation part 820 may include a pressing part 821 that moves downward to press the sealing member 40 so as to separate the sealing member 40 from the cover main body 810 and a connection part 822 that connects the cover main body 810 to the pressing part 821 so that the pressing part 821 is movable downward for elastic deformation.

The pressing part 821 may be a configuration that moves downward to presses the sealing member 40 so as to separate the sealing member 40 from the cover part main body 810, and may be variously configured as long as the pressing part 821 is installed on the cover main body 810 so as to movable downward.

For example, the pressing part 821 may have various shapes, such as a circular, oval, rectangular, or star-shaped planar shape.

In addition, the pressing part 821 may be capable of various functions depending on a structure of the connection part 822, such as maintaining a descending state when pressed by the user or returning to its original position by elasticity.

The pressing part 821 may be provided with one or more pressing parts 323 on the bottom surface that press the sealing member 40.

The pressing part 323 may be a configuration that presses the sealing member 40 by the downward movement of the pressing part 821 and may be provided in one or more.

The pressing part 323 may have any configuration as long as the pressing part 323 presses the sealing member 40.

For example, the pressing part 323 may have various shapes, such as a ring shape or a semicircular shape.

In addition, as another example, the pressing part 323 may have various shapes depending on the planar shape of the pressing part 821.

For example, the pressing part 821 may be provided eccentrically from the center of the container cap 20, and in this case, the pressing part 323 may also have various structures depending on the position and shape of the pressing part 821.

In addition, when the pressing part 821 is provided in a circle shape that is eccentric from the center of the container cap 20, the pressing part 323 may have various planar shapes such as circular and square.

The connection part 822 may be a configuration that connects the cover main body 810 to the pressing part 821 so that the pressing part 821 is movable downward by the elastic deformation, and various configurations are possible.

In particular, it is preferable that the connection part 822 is integrated with the pressing part 821 and the cover main body 810.

Furthermore, it is desirable for the connection part 822 to maintain the vertically movable state, such as returning to its original state after the pressing part 821 descends, and for this, the connection part 822 may have various structures such as a thin film or bellows structure.

In addition, the connection part 822 may be provided to vertically isolate the cover main body 810 together with the pressing part 821, as illustrated in FIGS. 19*a* to 19*d*.

That is, it is preferable that the entire container cap 20 is formed by injection, and the sealing member separation part 820 may be preferably integrated with the cover min body 810 to seal the container 30 when the cover main body 810 is coupled to the container inlet 20.

Here, when the sealing member 40 is coupled to the container cap 20, a separate sealed auxiliary space S1 may be defined in the state in which the sealing member 40 is coupled to the container cap 20, and an auxiliary material to be drunk when drinking may be contained in the auxiliary space S1.

The auxiliary material may be any material that is capable of being contained in the auxiliary space S1, such as granular materials, powder-like materials, or liquid materials.

In addition, although not shown, the connection part 822 may be provided as a plurality of bands capable of the elastic deformation between an inner circumference of the cover main body 810 and the pressing part 821.

Here, the connection part 822 may not be sealed in a vertical direction of the container cap 20, and thus, it is preferable that the sealing member 40 remains in the state in which the sealing member 40 is coupled to the container cap 30.

When the connection part 822 is provided as the plurality of bands, various configurations such as a zigzag structure and a wire structure are possible.

In addition, one or more bridges (not shown) installed along the circumferential direction to confirm whether the pressing part 821 initially descends may be provided between the inner circumference of the cover main body 810 and the pressing part 821.

The bridge may be a configuration that is installed along the circumferential direction to check whether the pressing part 821 initially descends and may be provided as a thin band connecting the inner circumference of the cover part 810 to the pressing part 821. Here, the connection part 822 may be preferably elastically deformable to allow the pressing part 821 to descend, and the bridge 219 may be preferably formed to be ruptured when the pressing part 821 descends.

The container assembly having the above configuration may be used through the following process.

First, the sealing member 40 may be coupled to the container 30 in the state of being inserted into the container cap 20 depending on the type of contents contained in the container 30, such as beverages (beverages such as milk, vinegar, soy sauce, juice, soybean oil, sauce, etc.), alcoholic beverages, engine oil, antifreeze, cooking oil, dairy products, etc.

In addition, the sealing member 40 may adhere to the coupling part 830 of the container cap 20 and the top surface 22*a* of the container inlet 20 to seal the container 30 by a high frequency, that is, induction.

The container assembly distributed on the market through the above process may be used by separating the container cap 20 from the container 30 by the user.

Here, when the container cap 20 is separated from the container 30, the coupling force of the sealing member 40 to the container cap 20 may be greater than that to the container inlet 20, and thus, the sealing member 40 may also be separated from the container inlet 20 together with the separation of the container cap 20.

When the container cap 20 is separated, the sealing member 40 may also be separated, and thus, the user may tilt the container 30 to drink or use the contents according to the intended purpose.

The user may use the contents of the container 30 repeatedly other than at once. In this case, the container cap 20 is coupled to the container 30 to seal the container 30.

Here, the container 30 may be effectively sealed by providing the sufficient sealing force to the container 30 when being recouped to the container 30 in the state of being coupled to the container cap 20 according to the configuration of the sealing member 40.

In addition, the container assembly according to the present invention may be characterized by providing the sufficient sealing force of the container cap 20 to the container 30 even when the sealing member 20 is removed from the container cap 20 due to the structure described above.

Furthermore, the container assembly according to the present invention may provide the sufficient sealing force of the container cap 20 to the container 30 even if the sealing member 20 is removed from the container cap 20 as follows.

In the case of the fourth embodiment of the present invention, an embodiment provided with the separation part 300 and the fixing part 400 has been described, but the embodiment may also be implemented without the separation part 300 and the fixing part 400.

Role of Handle and Injection Molding

In the container cap 10 according to the present invention, at least one of the separation part 300 or the fixing part 400 may be disposed at positions opposite to the hinge part 530 described above, and the separation part 300 and the fixing part 400, which are coupled to each other, may be used as a handle for opening the container 30 by separating the cover part 200 from the main body part 100 due to the user's manipulation.

The container cap 10 having the above configuration may be formed by injecting a synthetic resin material.

Here, in the container cap 10 according to the present invention, it is preferable that the main body part 100, the cover part 200 and the separation part 300 are integrally formed in consideration of manufacturing convenience and recycling after use.

Container Structure

The container cap 10 having the above configuration may be coupled to the container having the various structures, such as the container disclosed in WO2021/071348 A1.

Particularly, the container cap 10 according to the present invention is suitable for a container 30 containing powder, in particular, contents having a granular structure, and the container 30 structure may also be specialized in discharging the contents having the granular structure.

The container cap 10 according to the above-described embodiments has been described as having the structure in which the main body part 100 and the cover part 200 are integrated with each other by the hinge part 530, but the container cap 10 may have a structure in which the main body part 100 and the cover part 200 are separated from each other without provided with the hinge part 530, i.e., a 2-piece structure.

Although the above description merely corresponds to some exemplary embodiments that may be implemented by the present invention, as well known, the scope of the present invention should not be interpreted as being limited to the above-described embodiments, and all technical spirits having the same basis as that of the above-described technical spirit of the present invention are included in the scope of the present invention.

The invention claimed is:

1. A container cap comprising:

a main body part which is coupled to a container inlet of a container containing contents and has an opening defined in an upper side thereof;

a cover part which is integrally connected to the main body part by a hinge part to open and close an upper opening of the main body part by hinge rotation;

a separation part which is integrally connected to the cover part by a first connection part and is integrally detachably connected to the main body part by a second connection part; and a fixing part disposed on the cover part so that the separation part is fixedly coupled thereto after the second connection part is separated by a user's manipulation so that the cover part is separated from the main body part;

wherein the separation part is provided with one or more concave parts when viewed at an upper side in a state of being connected to the main body part, and the fixing part is provided with a protrusion fitted into a concave part of the separation part by separating and tilting the separation part from the main body part; and wherein the fixing part comprises a covering part having a projected area that comprises an entire upper side of the protrusion when viewed from above.

2. The container cap of claim 1, wherein each of the one or more concave parts and the protrusion are provided in a pair to correspond to each other.

3. The container cap of claim 1, wherein the covering part is provided with a hook part protruding downward from a center of the container cap at an end portion, and the separation part is provided with a fitting groove into which the hook part is fitted in the a state of being separated from the main body part and folded upward.

4. The container cap of claim 1, wherein the main body part is provided with a cutoff part corresponding to an outer circumferential shape of the separation part, and the second connection part is provided in one or more second connection parts to be connected between an edge of the separation part and an inner circumference of the cutoff part.

5. The container cap of claim 1, wherein the cover part is provided with an inner ring that protrudes from a bottom surface and is inserted into an inner circumferential surface of the container inlet to improve sealing force of the container.

6. The container cap of claim 5, wherein the container inlet is provided with a convex portion that is convex inward to be in contact with the inner circumferential surface of the inner ring in a state in which the cover part is coupled to the main body part.

7. The container cap of claim 1, wherein the main body part is provided with a fourth hook protrusion that is hooked with a third hook protrusion disposed on an outer circumferential side of the container inlet so as to be fixed to the container inlet.

8. A container comprising:

a container containing contents; and a container cap of claim 1, which is coupled to a container inlet of the container.

9. The container of claim 8, wherein each of the one or more concave parts and the protrusion are provided in a pair to correspond to each other.

10. The container of claim 8, wherein the concave part has a narrow inlet portion based on an insertion direction, and the protrusion has a wider width at an end portion thereof to correspond to the inlet portion of the concave part.

11. A container cap comprising:

a main body part which is coupled to a container inlet of a container containing contents and has an opening defined in an upper side thereof;

a cover part which is integrally connected to the main body part by a hinge part to open and close an upper opening of the main body part by hinge rotation;

a separation part which is integrally connected to the cover part by a first connection part and is integrally detachably connected to the main body part by a second connection part; and a fixing part disposed on the cover part so that the separation part is fixedly coupled thereto after the second connection part is separated by a user's manipulation so that the cover part is separated from the main body part;

wherein the separation part is provided with one or more concave parts when viewed at an upper side in a state of being connected to the main body part, and the fixing part is provided with a protrusion fitted into a concave part of the separation part by separating and tilting the separation part from the main body part; and wherein the concave part has a narrow inlet portion based on an insertion direction, and the protrusion has a wide width at an end portion thereof to correspond to the inlet portion of the concave part.

12. The container cap of claim 11, wherein the concave part is provided with a first convex part that protrudes further from a central portion toward an outer portion when viewed from above, and the protrusion is provided with a second convex part that faces the first convex part of the concave part to further protrude.

13. A container cap comprising:

a main body part which is coupled to a container inlet of a container containing contents and has an opening defined in an upper side thereof;

a cover part which is integrally connected to the main body part by a hinge part to open and close an upper opening of the main body part by hinge rotation;

a separation part which is integrally connected to the cover part by a first connection part and is integrally detachably connected to the main body part by a second connection part; and a fixing part disposed on the cover part so that the separation part is fixedly coupled thereto after the second connection part is separated by a user's manipulation so that the cover part is separated from the main body part;

wherein the separation part is provided with one or more concave parts when viewed at an upper side in a state of being connected to the main body part, and the fixing part is provided with a protrusion fitted into a concave part of the separation part by separating and tilting the separation part from the main body part;

wherein the cover part is provided with an inner ring that protrudes from a bottom surface and is inserted into an inner circumferential surface of the container inlet to improve sealing force of the container; and wherein the inner ring has a portion corresponding to the hinge part, which further protrudes downward than a portion corresponding to the fixing part.

14. A container cap comprising:

a main body part which is coupled to a container inlet of a container containing contents and has an opening defined in an upper side thereof;

a cover part which is integrally connected to the main body part by a hinge part to open and close an upper opening of the main body part by hinge rotation;

a separation part which is integrally connected to the cover part by a first connection part and is integrally detachably connected to the main body part by a second connection part; and a fixing part disposed on the cover part so that the separation part is fixedly coupled thereto after the second connection part is separated by a user's manipulation so that the cover part is separated from the main body part;

wherein the separation part is provided with one or more concave parts when viewed at an upper side in a state of being connected to the main body part, and the fixing part is provided with a protrusion fitted into a concave part of the separation part by separating and tilting the separation part from the main body part;

wherein the cover part is provided with an inner ring that protrudes from a bottom surface and is inserted into an inner circumferential surface of the container inlet to improve sealing force of the container; and wherein the inner ring comprises:

a first portion provided at a preset angle by using the fixing part as a center of an angle and having a constant vertical distance; and a second portion having a center of the hinge part as the lowest point and having a vertical distance that increases downward from the first portion.

15. A container cap comprising:

a main body part which is coupled to a container inlet of a container containing contents and has an opening defined in an upper side thereof;

a cover part which is integrally connected to the main body part by a hinge part to open and close an upper opening of the main body part by hinge rotation;

a separation part which is integrally connected to the cover part by a first connection part and is integrally detachably connected to the main body part by a second connection part; and a fixing part disposed on the cover part so that the separation part is fixedly coupled thereto after the second connection part is separated by a user's manipulation so that the cover part is separated from the main body part;

wherein the separation part is provided with one or more concave parts when viewed at an upper side in a state of being connected to the main body part, and the fixing part is provided with a protrusion fitted into a concave part of the separation part by separating and tilting the separation part from the main body part;

wherein the cover part is provided with an inner ring that protrudes from a bottom surface and is inserted into an inner circumferential surface of the container inlet to improve sealing force of the container;

wherein the container inlet is provided with a convex portion that is convex inward to be in contact with the inner circumferential surface of the inner ring in a state in which the cover part is coupled to the main body part; and wherein the cover part further comprises an auxiliary inner ring that is in close contact with an inner circumferential surface of the container inlet outside the inner ring.

16. A container cap comprising:

a main body part which is coupled to a container inlet of a container containing contents and has an opening defined in an upper side thereof;

a cover part which is integrally connected to the main body part by a hinge part to open and close an upper opening of the main body part by hinge rotation;

a separation part which is integrally connected to the cover part by a first connection part and is integrally detachably connected to the main body part by a second connection part; and a fixing part disposed on the cover part so that the separation part is fixedly coupled thereto after the second connection part is separated by a user's manipulation so that the cover part is separated from the main body part; and wherein the cover part is provided with a second hook protrusion protruding toward an inner circumference so as to be hooked on the a first hook protrusion protruding toward an outer circumference near an upper end of the container inlet.

* * * * *